US011247894B2

(12) United States Patent
Drake

(10) Patent No.: US 11,247,894 B2
(45) Date of Patent: Feb. 15, 2022

(54) VEHICULAR FUEL-SELECTING SYSTEM, APPARATUS, AND METHOD

(71) Applicant: Dean A. Drake, Linden, MI (US)

(72) Inventor: Dean A. Drake, Linden, MI (US)

( * ) Notice: Subject to any disclaimer, the term of this patent is extended or adjusted under 35 U.S.C. 154(b) by 0 days.

(21) Appl. No.: 17/017,899

(22) Filed: Sep. 11, 2020

(65) Prior Publication Data

US 2021/0078851 A1 Mar. 18, 2021

Related U.S. Application Data

(60) Provisional application No. 62/899,295, filed on Sep. 12, 2019.

(51) Int. Cl.
*B67D 7/04* (2010.01)
*B67D 7/42* (2010.01)

(52) U.S. Cl.
CPC ..... *B67D 7/0401* (2013.01); *B67D 7/42* (2013.01); *B67D 2007/0474* (2013.01)

(58) Field of Classification Search
CPC ..... B67D 7/0401; B67D 7/425; B67D 7/428; B67D 7/42; B67D 2007/0453; B67D 2007/0474; B60K 2015/049; B60K 2015/03203; B60K 2015/0323; B60K 2015/0319; B60K 2015/03197; G06Q 20/3276
See application file for complete search history.

(56) References Cited

U.S. PATENT DOCUMENTS

| | | | | |
|---|---|---|---|---|
| 1,850,626 A | | 3/1932 | Hukill | |
| 3,288,179 A | * | 11/1966 | Romanowski | B67D 7/48 141/225 |
| 3,343,723 A | * | 9/1967 | Richards | B67D 7/425 222/75 |
| 3,521,679 A | * | 7/1970 | Copony | B67D 7/48 141/208 |
| 3,730,216 A | | 5/1973 | Arnett et al. | |
| 4,034,784 A | | 7/1977 | Ball et al. | |
| 4,153,085 A | | 5/1979 | Adams | |
| 4,195,673 A | | 4/1980 | Johnston et al. | |
| 4,469,149 A | * | 9/1984 | Walkey | B67D 7/14 141/346 |
| 5,249,612 A | * | 10/1993 | Parks | B67D 7/348 141/219 |

(Continued)

*Primary Examiner* — Andrew D StClair
(74) *Attorney, Agent, or Firm* — Carrier Blackman & Associates, P.C.; William D. Blackman; Joseph P. Carrier

(57) ABSTRACT

A fuel delivery system automatically selects one out of several available fuels for a vehicle having a specialized fuel filler neck. A dispenser pump assembly includes a pump base, a hose assembly and a nozzle assembly which includes a nozzle spout and a cylindrical collar member slidably mounted on the nozzle spout. A sensor on the nozzle assembly generates a signal, based on a position of the collar when the spout is fully inserted into a fuel filler neck of the vehicle. The signal is transmitted via wires, wireless signal, fiber-optic cables or other medium. An electronic controller in the pump base selects an appropriate fuel, based on the signal received from the sensor. If the available fuels include percentages of ethanol or other additives, a precision blending system ensures that the correct amount of additive is provided. Methods of selecting a fuel using the system hereof are also disclosed.

7 Claims, 23 Drawing Sheets

(56) References Cited

U.S. PATENT DOCUMENTS

| | | | | |
|---|---|---|---|---|
| 5,365,984 | A | 11/1994 | Simpson et al. | |
| 5,390,712 | A | 2/1995 | Parrish et al. | |
| 5,605,182 | A * | 2/1997 | Oberrecht | B67D 7/145 141/231 |
| 5,645,115 | A | 7/1997 | Kesterman et al. | |
| 5,729,002 | A * | 3/1998 | Samples | B60K 15/04 235/380 |
| 5,857,501 | A * | 1/1999 | Kelerich | B67D 7/348 141/94 |
| 6,019,146 | A * | 2/2000 | Taylor | B67D 7/16 141/100 |
| 6,024,142 | A * | 2/2000 | Bates | B67D 7/145 141/351 |
| 6,571,151 | B1 | 5/2003 | Leatherman | |
| 8,100,155 | B2 | 1/2012 | Bar et al. | |
| 8,844,587 | B1 * | 9/2014 | McCommons | B67D 7/42 141/347 |
| 8,869,846 | B2 | 10/2014 | Gerdes | |
| 9,242,849 | B2 * | 1/2016 | Kunter | B67D 7/34 |
| 10,703,623 | B1 * | 7/2020 | Main | B67D 7/54 |
| 10,737,928 | B2 * | 8/2020 | Wiersma | B67D 7/428 |
| 2008/0190515 | A1 * | 8/2008 | Cartwright | B67D 7/42 141/193 |
| 2011/0233233 | A1 | 9/2011 | Winsness | |
| 2014/0048173 | A1 * | 2/2014 | Fedde | B67D 7/42 141/311 A |

* cited by examiner

Operation in a Legacy Vehicle

Filler Neck Designed for Fuel "A"

Filler Neck Assembly Designed for Fuel "B"

Filler Neck Assembly Designed for Fuel "C"

| Dimension | Voltage From Load Cell | Fuel or Fuel Blend |
|---|---|---|
| 0 | 1 | Legacy |
| X | 2 | A |
| Y | 3 | B |
| Z | 4 | C |

FIG. 13

Spout and Filler Neck for Fuel "A"

Spout and Filler Neck for Fuel "B"

Spout
and Filler
Neck for
Fuel "C"

VEHICULAR FUEL-SELECTING SYSTEM, APPARATUS, AND METHOD

CROSS-REFERENCE TO RELATED APPLICATIONS

The present application claims priority under 35 USC 119(e) to U.S. Provisional Patent application 62/899,295, filed Sep. 12, 2019. The entire disclosure of the referenced priority application, including specification, claims and drawings, is incorporated by reference herein.

BACKGROUND OF THE INVENTION

1. Field of the Invention

The present invention relates to a vehicular fuel-selecting system and apparatus, and to a method of using the system and apparatus to select and if necessary, blend an appropriate fuel for a vehicle.

More particularly, the present invention relates to a vehicular fuel-selecting system and apparatus in which one of a plurality of liquid fuels is automatically selected and dispensed for a particular vehicle through a single hose and nozzle, based on an interaction between a fuel filler neck on the vehicle and a fuel dispenser pump nozzle assembly.

Description of the Background Art

A number of different fuel filler necks and dispenser pump nozzle assemblies are known. As one example, when unleaded gas became commonly used in the automotive industry, the diameter of dispenser nozzle spout was reduced for pumps which dispensed unleaded gas, and the size of an opening formed in vehicle fuel filler necks was reduced accordingly, so that a larger pump nozzle would be unable to fit in a fuel filler neck of an unleaded vehicle.

In past instances when certain vehicles required a specific fuel and/or must be prevented from using a particular fuel, different diameter fuel filler nozzle spouts were used in conjunction with a hardened fuel filler neck restrictor that would permit the insertion of nozzle spout equal to or less than the diameter of the restrictor e.g., U.S. Pat. No. 3,730,216 dated May 1, 1973. The diameter of fuel nozzle spouts in nozzles intended for the sale of fuels incompatible with that vehicle would have diameters larger than the fuel filler neck restrictor and thus be unable to be used to refuel the vehicle.

This simple system had a significant drawback: each fuel required a separate fuel hose and nozzle. This was acceptable when the only two fuels at most retail outlets were gasoline with and without lead. Today, however, there are multiple types of gasoline blend fuels such as gasoline blended with ethanol that are only suitable in specific vehicles. Furthermore, most gasoline pumps have only a single hose and nozzle that deliver multiple fuel types.

Examples of some of the known fuel filler necks, and dispenser pump nozzle assemblies, and related technology include those described in U.S. Pat. Nos. 4,034,784, 4,153,085, 4,195,673, 5,365,984, 5,390,712, 5,645,115, 6,571,151, 8,100,155, and 8,869,846.

An example of a known ethanol blending system, as well as methods of blending gasoline with non-petroleum fuels at a retail station, is described in published US patent application 2011/0233233 A1.

In addition, U.S. Pat. No. 1,850,626 dated Mar. 22, 1932, discloses a low air pressure sensor activating a light to warn a driver that the air pressure on a vehicle's air brake system has fallen too low to be effective.

Although the known fuel filler necks and dispenser pump nozzle assemblies are useful for their intended purposes, a need still exists in the art for an improved vehicular fuel-selecting and dispensing system, apparatus and method. In particular, there is a need for an improved vehicular fuel-selecting and dispensing system, apparatus and method which will automatically select and, if necessary blend, an appropriate fuel for a specific vehicle.

SUMMARY OF THE INVENTION

Accordingly, it is an object of the present invention to provide a method and apparatus for automatically selecting a specified and, if necessary blend, an appropriate liquid fuel for a vehicle, when a fuel dispensing nozzle is inserted into a fuel filler neck of the vehicle.

The present invention provides a nozzle-based fuel selection and blending system, which is designed to allow any selected one of multiple fuel blends to be sold through the same hose and nozzle, and which automatically ensures that an appropriate fuel is used in each vehicle.

The system hereof may be adapted in large scale by the automotive and fuel industries. Alternatively, the system hereof may be adapted for private use such as in a fleet of privately-owned vehicles which require different fuel blends.

Where the traditional system of various nozzle diameters only uses the area of the nozzle's x and y axes, the current applicant's design utilizes the displacement of the collar member in a third, z axis to define other types of fuels suitable for use in a given vehicle such as, for example, fuels with different amounts of ethanol.

Important aspects of this selection system include equipping each vehicle with a specialized fuel filler neck, as well as a fuel dispensing pump assembly having the following features:

1. A relatively small diameter nozzle spout that conveys the fuel through a filler neck restrictor inside of the fuel filler neck on a vehicle, and delivers the fuel into the vehicle.
2. A sliding collar member, disposed on and surrounding the nozzle spout, that is configured to be displaced rearwardly on the nozzle spout if the diameter of the opening, in a particular vehicle's fuel filler neck restrictor, is smaller than the outer diameter of the collar member but larger than the diameter of the nozzle spout.
3. A locking provision that ensures that the nozzle is inserted into the fuel filler neck uniformly and securely, so that the rearward displacement of the collar member corresponds to the placement of the restrictor in the fuel filler nozzle and remains in place during the refueling operation.
4. A sensor on the nozzle assembly, which is configured to detect, measure and quantify an amount of movement of the collar member on the nozzle spout.
5. A transmitting medium, which may be selected from pneumatic hoses, electrical wires, wireless signal transmission, fiber-optic cables or other known signal transmission medium that is capable of sending information on the displacement of the collar member, from the sensor to a control computer in the fuel dispensing pump.
6. Software, firmware or other programming in the control computer that interprets information from the sensor to determine the degree of collar member displacement, and correspondingly to select which fuel is appropriate in the vehicle the nozzle spout is inserted into, based on the information from the sensor; and 7. A blending chamber in the body of the nozzle where different fuel components, such as for example gasoline and ethanol are mixed, in order to prevent residual contamination from one refueling to the next.

A fuel delivery system, according to a first illustrative embodiment of the invention, is configured to automatically select an appropriate fuel blend for a specific vehicle, out of a plurality of available fuels.

The fuel delivery system according to the first illustrative embodiment includes a pump base, a hose assembly operatively attached to the pump base, and a nozzle assembly affixed to a distal end of the hose assembly.

The fuel dispenser pump also includes an electronic controller configured to select an appropriate fuel based on at least one signal generated by a sensor disposed on the nozzle assembly.

In this first embodiment hereof, which is distinguished by using electronic communication between the fuel nozzle and the dispensing pump control computer, the nozzle assembly includes a body portion having a nozzle fuel channel formed therein, a valve subassembly including a trigger portion, and a nozzle spout in fluid communication with the nozzle fuel channel, the nozzle spout including a dispensing tube defining an outlet and having a stop member affixed to an exterior thereof.

The nozzle assembly also includes a cylindrical collar member slidably mounted on the nozzle spout, and a spring, disposed on the exterior of the dispensing tube between the stop member and the collar member.

The nozzle assembly also includes a collar position sensor, mounted between the spring and the stop member, which is configured to generate a collar position signal based on increased pressure from the compression of the spring as the collar member on the dispensing tube is displaced when the dispensing tube is fully inserted into a fuel filler neck of the specific vehicle.

The controller is configured to select an appropriate fuel for a given vehicle, based on the collar position signal received from the sensor.

Optionally, the nozzle assembly may include a wireless transmitter for wirelessly sending the signal to the controller.

Alternatively, the signal may be sent via optic fiber transmission.

The hose assembly has a hose fuel channel extending therethrough, and may also have at least one communication channel extending therethrough separate from the hose fuel channel.

The nozzle assembly has a nozzle fuel channel extending therethrough, and may also have at least one communication channel extending therethrough separate from the nozzle fuel channel.

The nozzle assembly also includes a valve subassembly with a trigger portion.

A second illustrative embodiment of the present invention, which is distinguished by using pneumatic or other non-electronic communication between the fuel nozzle and the dispensing pump control computer, provides a fuel delivery system configured to automatically select an appropriate fuel for a specific vehicle, out of a plurality of available fuels. The fuel delivery system according to the second illustrative embodiment hereof includes a fuel dispenser pump having an electronic controller therein, the fuel dispenser pump in fluid communication with a nozzle spout having a sliding collar member thereon that, when displaced by a restrictor in a fuel filler neck on a specific vehicle, vents at least one air pressure line connected to the nozzle spout and originating at the fuel dispenser pump.

The fuel delivery system according to the second illustrative embodiment may include a vehicle fuel filler neck with a restrictor member therein and disposed at a specified distance from a locking channel in an inlet of the filler neck, wherein, when the fuel dispenser nozzle is inserted, the restrictor displaces the collar member by the specified distance.

The fuel delivery system according to the second illustrative embodiment also includes at least one pressurized airline extending to the nozzle spout from the fuel dispenser pump, and at least one air pressure sensor, in the fuel dispenser pump, that is configured to generate an signal, readable by the electronic controller, when air pressure in the at least one air pressure line is reduced by a specified amount.

In a third illustrative embodiment hereof, the present invention encompasses a method of selecting a fuel or fuel blend to be dispensed into a vehicle. The method includes a first step of inserting a nozzle spout of a nozzle assembly, operatively connected to a dispensing pump, into a fuel filler neck of a vehicle having a restrictor member therein with a calibrated opening formed in the restrictor member.

The method according to the third illustrative embodiment may also include a step of placing a tip of the nozzle spout into the opening of the restrictor member, and moving the nozzle spout, in relation to the fuel filler neck, until a collar member on the nozzle tip is displaced by a specified distance.

The method according to the third illustrative embodiment may also include a step of generating a signal based on the distance that the collar member is displaced, and sending the signal to a processor.

The method according to the third illustrative embodiment also includes a step of selecting one of a plurality of fuels based on the signal received by the processor.

A fourth illustrative embodiment of the present invention provides an additional method of selecting a fuel to be dispensed into a vehicle, using the system according to the second embodiment.

The fuel-selecting method according to the fourth illustrative embodiment includes a first step of inserting a nozzle of a dispensing pump into a fuel filler neck of a vehicle having a restrictor member therein, with an opening formed in the restrictor member.

The fuel-selecting method according to the fourth illustrative embodiment also includes a second step placing a tip of the nozzle into the opening of the restrictor member, and moving the nozzle inwardly in relation to the fuel filler neck until a collar member on the nozzle tip is displaced by a specified distance.

The fuel-selecting method according to the fourth illustrative embodiment also includes a third step of engaging a tooth, disposed inside of the vehicle's fuel filler neck, in a retaining channel formed by a slot in the flange on the nozzle, the retaining channel disposed at the specified distance from the restrictor member.

In practicing the method according to the fourth illustrative embodiment, when the collar member on the nozzle tip is displaced, a valve opens to release compressed air from the nozzle tip and to lower an air pressure level in a chamber of a signal converter, where the chamber is in fluid communication with a compressed air passage in the nozzle tip.

The fuel-selecting method according to the fourth illustrative embodiment also includes a fifth step of generating a signal based on the lowered air pressure level in said chamber measured by a sensor, and sending the signal to a processor.

The fuel-selecting method according to the fourth illustrative embodiment also includes a sixth step of selecting one of a plurality of fuels, based on receipt of the signal by the processor, and may include a final step of dispensing the selected fuel into the vehicle via the fuel filler neck.

For a more complete understanding of the present invention, the reader is referred to the following detailed description section, which should be read in conjunction with the drawings. Throughout the following detailed description and in the drawings, like numbers refer to like parts.

BRIEF DESCRIPTION OF THE DRAWINGS

FIG. 13 is a table showing a relationship between a distance that the collar moves on the nozzle spout, and a selected fuel or fuel blend.

DETAILED DESCRIPTION

Figure 1:
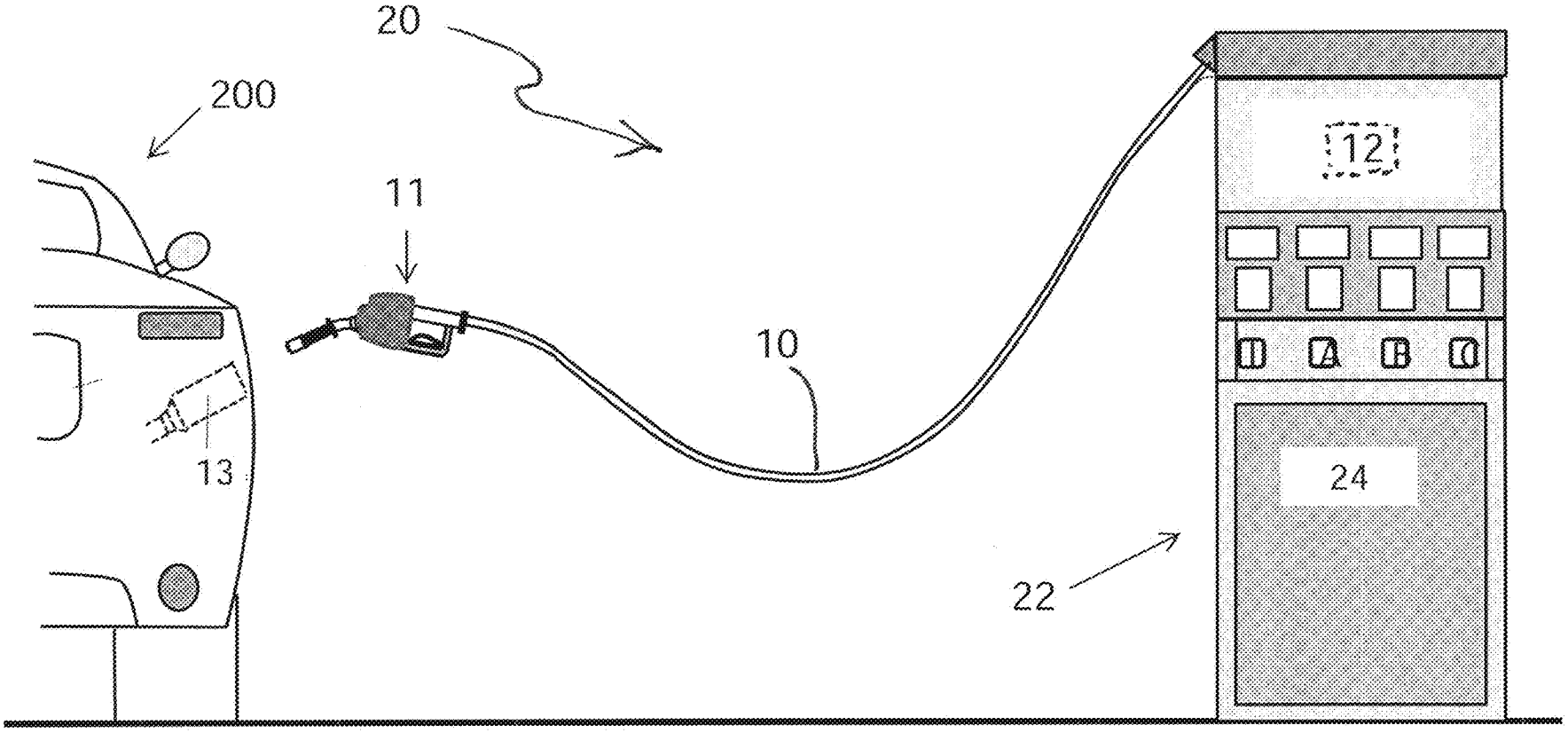
FIG. 1 is a side elevational view showing an overview of a fuel delivery system and pump assembly according to a first illustrative embodiment of the present invention, along with a vehicle ready to be refueled.

It should be understood that only structures and methodology needed for illustrating selected embodiments of the present invention are described herein. Other conventional structures, and those of ancillary and auxiliary components of the system, will be known and understood by those skilled in the art.

System Overview—First Embodiment

The present invention provides a fuel delivery system configured to automatically select an appropriate fuel for a specific vehicle, out of a plurality of available fuels.

The system hereof may be adapted in large scale by the automotive and fuel industries. Alternatively, the system hereof may be adapted for private use such as in a fleet of privately-owned vehicles which require different fuel blends.

A fuel delivery system 20 according to a first illustrative embodiment of the invention includes a fuel pump assembly 22 including a pump base 24, a hose assembly 10 operatively attached to the pump base, and a nozzle assembly 11 affixed to a distal end of the hose assembly and spaced away from the pump.

The fuel dispenser pump 22 also includes an electronic controller 12 disposed inside of the pump base 24 and configured to select an appropriate fuel, based on at least one signal received from the nozzle assembly 11.

Figure 5A:
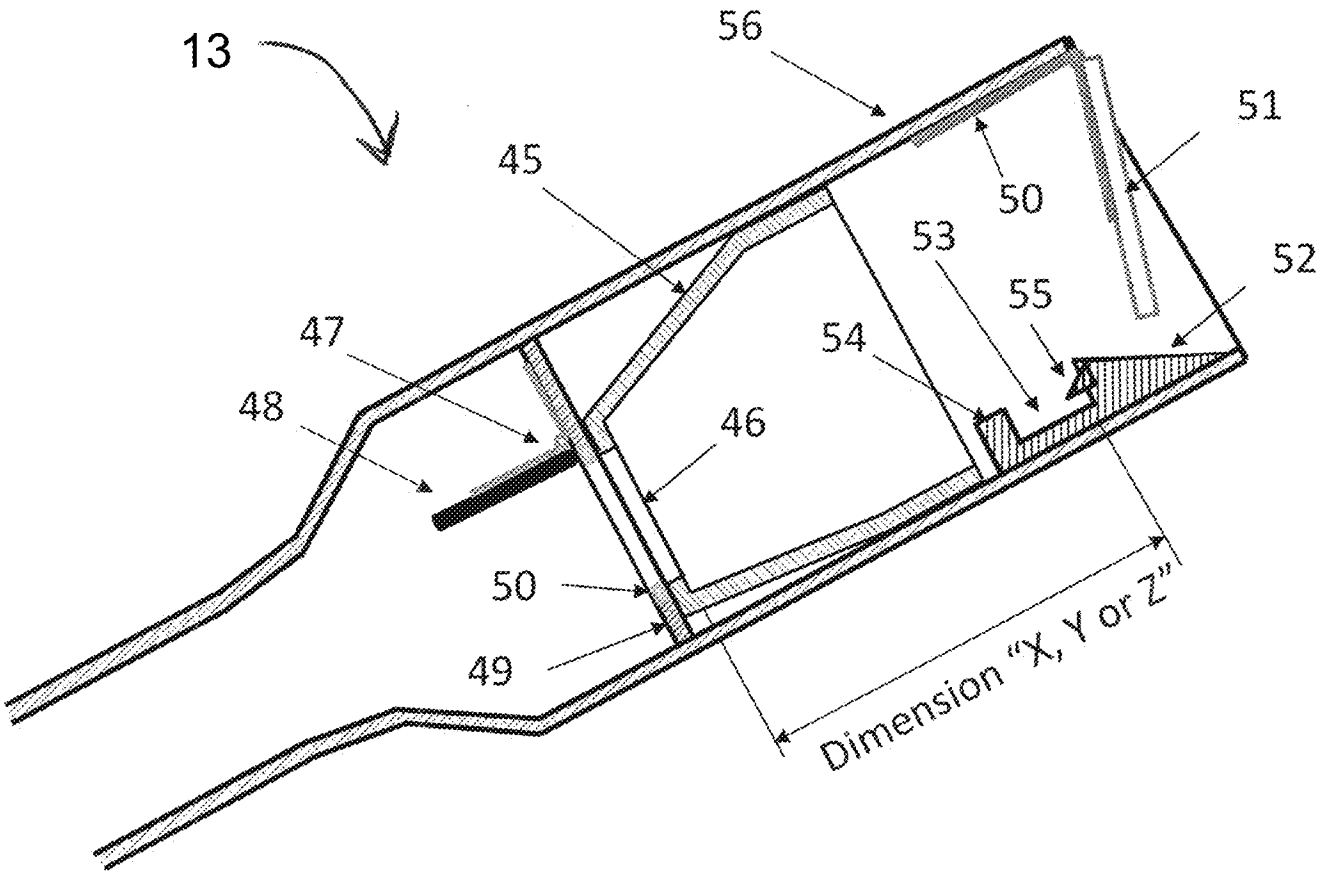
FIG. 5A is a cross-sectional view of an illustrative sample fuel filler neck assembly, configured to be placed inside of a vehicle and used with the system of the present invention.

The system 20 hereof is designed to work in conjunction with a series of specialized filler necks, such as the one shown at 13 in FIGS. 1 and 5A, which are selectively and respectively installed in vehicles that are configured to work with the system.

Figure 2:
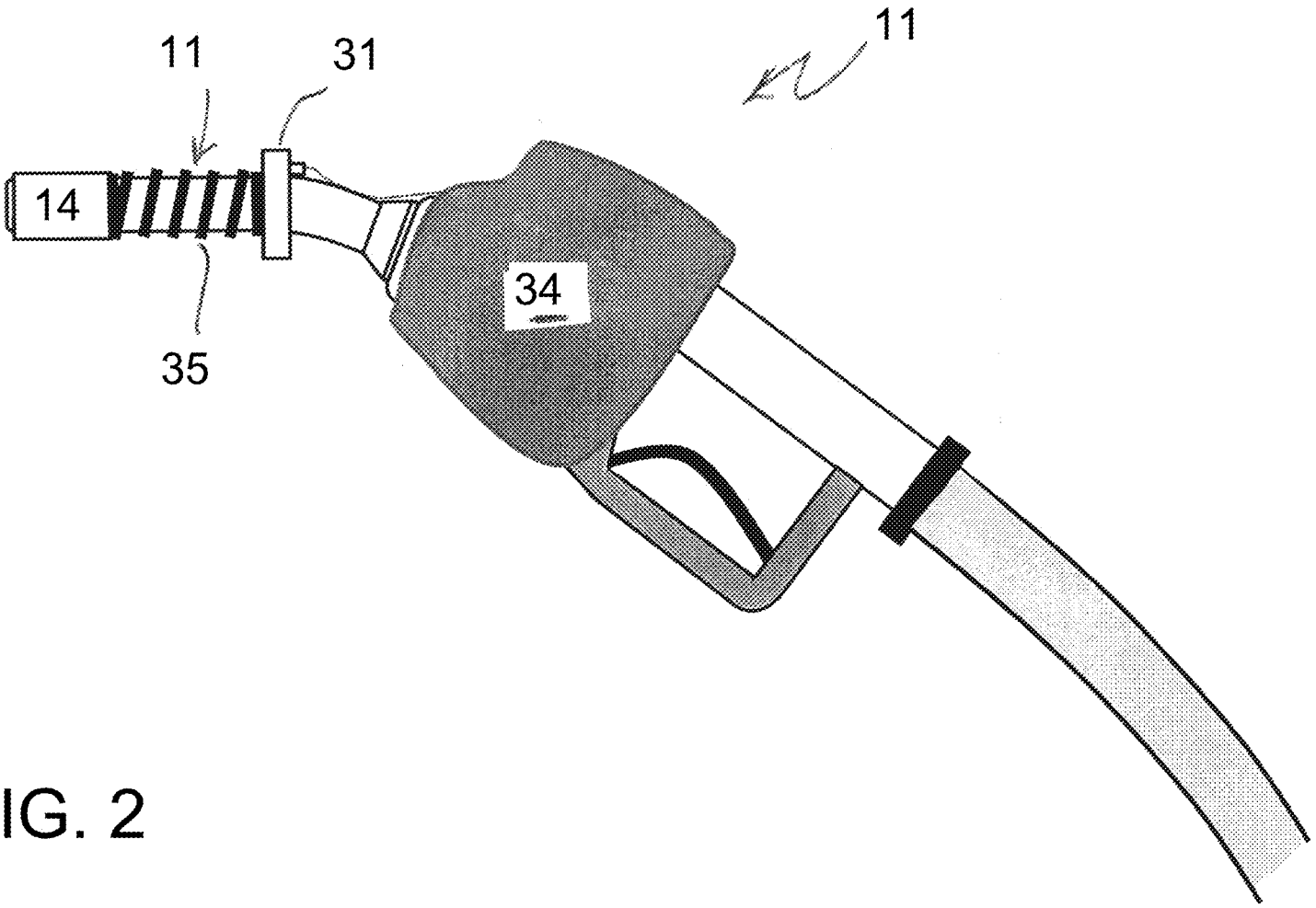
FIG. 2 is a detail side plan view of a nozzle assembly which is one component of the system of FIG. 1.

The system 20 according to the present invention includes the following features, some of which may be optional:

i. A nozzle spout 37 (FIG. 2), having a relatively small diameter, that conveys fuel through the vehicle's filler neck restrictor, and delivers fuel from the pump base 24 into the vehicle 200.

ii. A sliding collar member 14, which surrounds and is slidably disposed on the nozzle spout 37, and that is configured to be displaced rearwardly on the nozzle spout 37 if the diameter of an opening, in a specific vehicle's fuel filler neck restrictor 45, is smaller than the outer diameter of the collar member, but large enough to receive the nozzle spout 37 therethrough.

iii. A load sensor 31*b* on the nozzle assembly 11 which is configured to detect, measure and quantify an amount of movement of the collar member 14 on the nozzle spout 37, based on the pressure exerted on the sensor by the spring.

iv. A locking feature of the filler neck 13 that ensures that the nozzle spout 37 is inserted into the vehicle's fuel filler neck 13 uniformly and a predetermined distance, so that a rearward displacement of the collar member 14 corresponds to the placement of the nozzle spout in the filler neck. The locking mechanism also prevents the nozzle assembly from being ejected from the filler neck by the force of the spring.

v. A transmitting medium, which may be selected from pneumatic hoses, electrical wires, wireless signal transmission, fiber-optic cables or other known signal transmission medium that is capable of sending information from the sensor 31, on the degree of displacement of the collar member 14, to the control computer 12 in the fuel dispensing pump base 24.

vi. Software, firmware or other programming in the control computer 12, that interprets information from the load sensor 31*b* to determine the degree of collar member displacement, and is operable to select which fuel blend is appropriate for the vehicle 200 that the nozzle spout 37 is inserted into from a plurality of available fuel blends, based on the information from the sensor.

A blending chamber (not shown) may be provided in a body 34 of the nozzle assembly 11, where fuel components such as, for example, gasoline and ethanol are mixed, in order to minimize or prevent residual contamination from one refueling to the next.

A key component of the system 20 hereof is that a fuel delivery spout 37, of the nozzle assembly 11, has a spring-loaded slidable collar member 14 disposed on a tip end thereof. A position of the collar member on the nozzle, when used in conjunction with a calibrated fuel filler neck 13 on a vehicle 200 which is configured to work together with the system hereof, is measured by a sensor 31 on the nozzle assembly. The load sensor 31*b* sends a signal back to the pump base 24, and that signal is used by a control computer 12, disposed in the pump base 24, to select an appropriate grade of fuel for the vehicle 200.

Figure 3A:
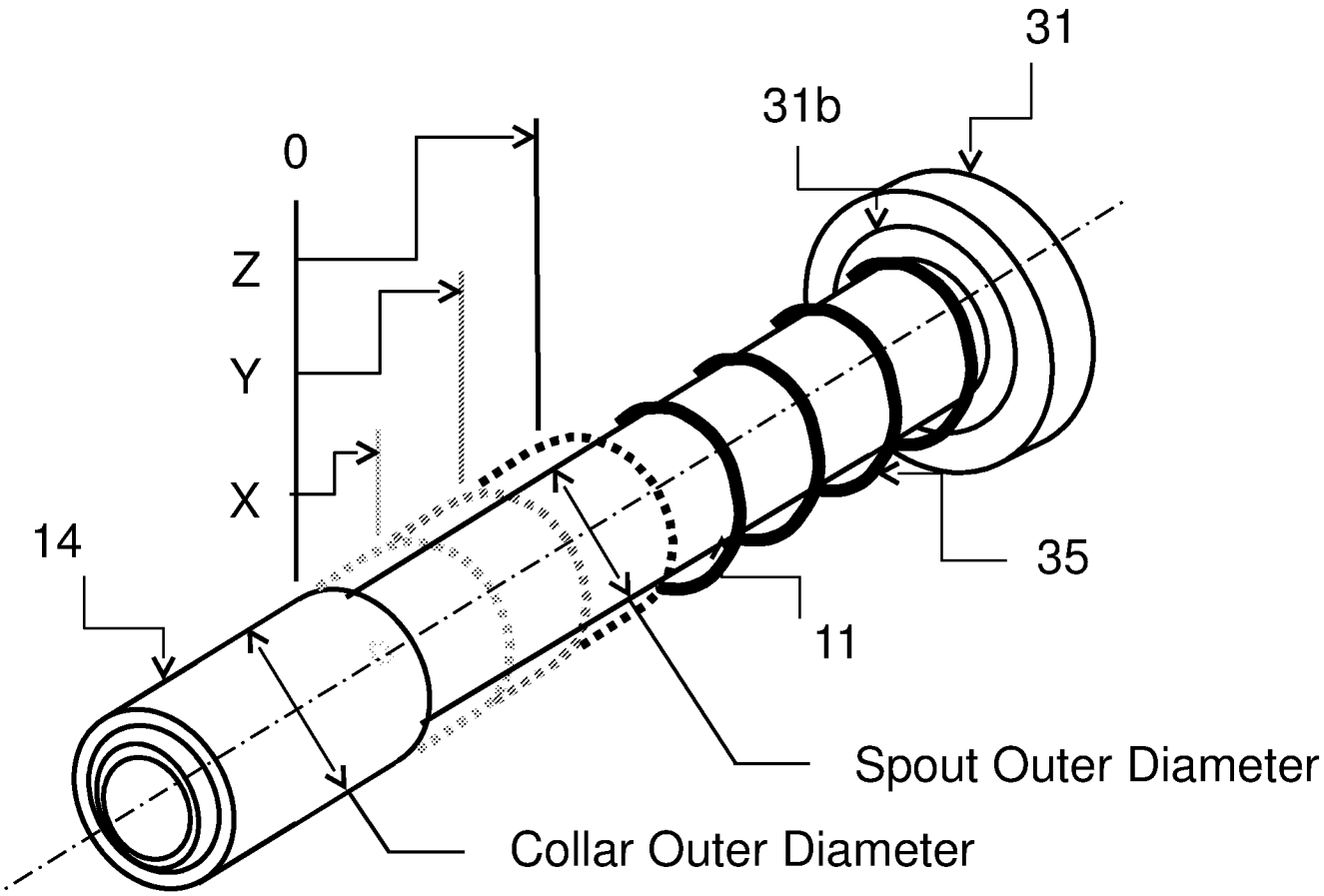
FIG. 3A is a detail perspective view of a spout portion of the nozzle assembly of FIG. 2, showing different alternative positions to which a collar member, surrounding a dispenser tube thereof, may be moved.
Figures 3B, 3C:
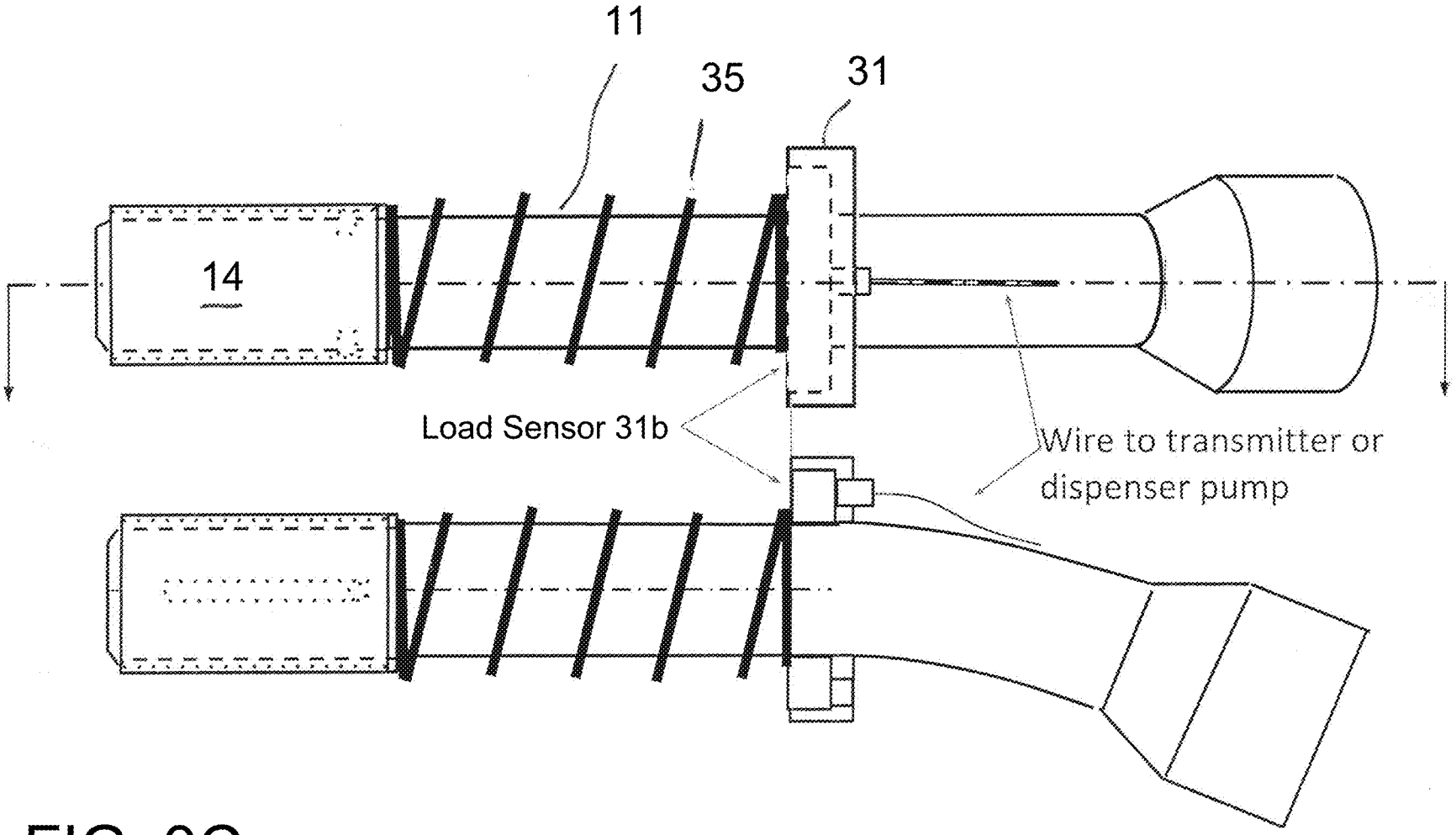
FIGS. 3B-3C are top and side plan views showing details of the nozzle assembly including the collar member disposed outside of the dispenser tube, as well as a position sensor.
Figure 3D:
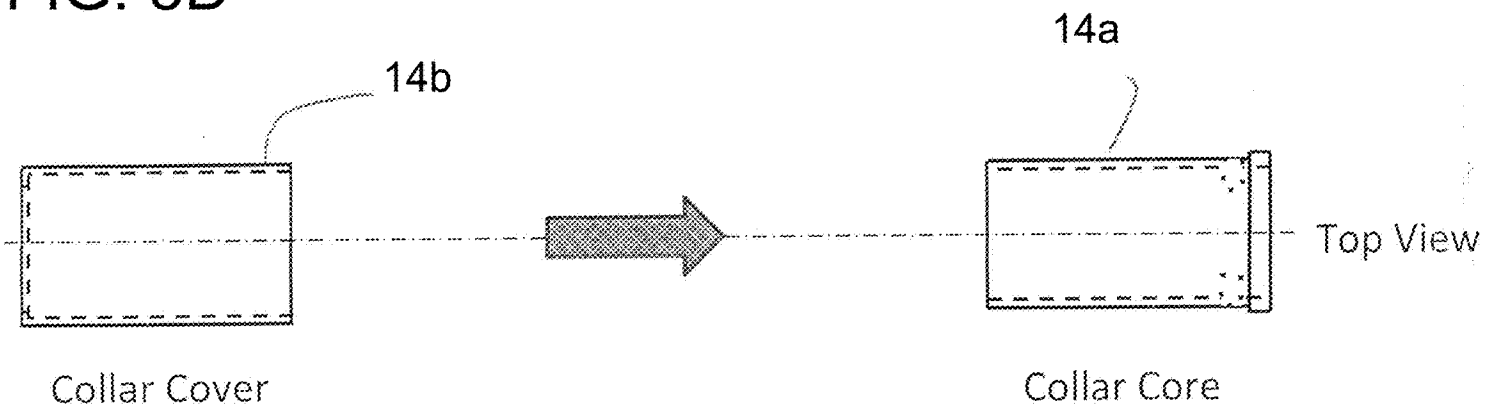
FIGS. 3D-3E are top and side plan views showing subcomponents of a collar member, which is a component part of the nozzle assembly.
Figure 3E:
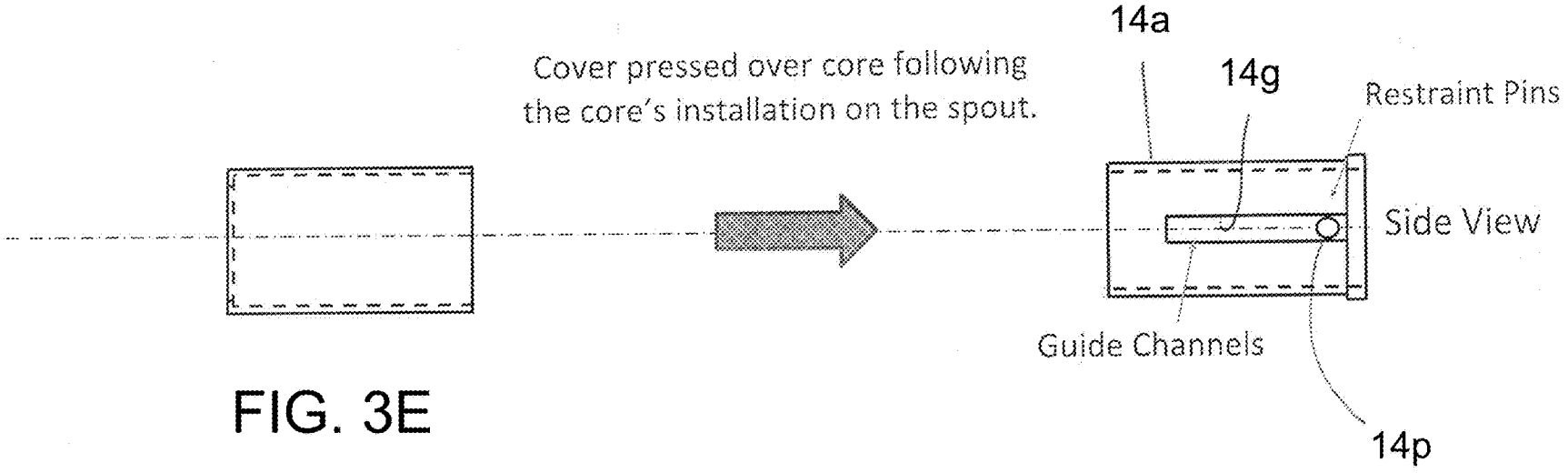
Figure 3F:
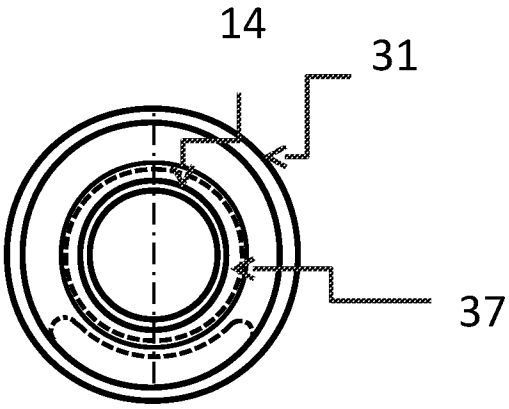
FIG. 3F is an end plan view of the nozzle assembly.

As shown in FIGS. 3D and 3E, in the depicted embodiment, the collar member 14 includes an inner collar core 14*a* as well as an outer collar cover 14*b* slidably disposed over the collar core. The collar core 14*a* may have a guide channel or slot 14*g* formed therein, and the nozzle spout 37 may have a restraint pin 14 *p* extending outwardly thereon.

The pump nozzle assembly 11 also includes a load sensor 31*b*, which is adapted to send a signal, corresponding to an amount of movement of the collar member 14 on the nozzle spout 37, to the controller 12 in the pump base 24.

Figure 4:
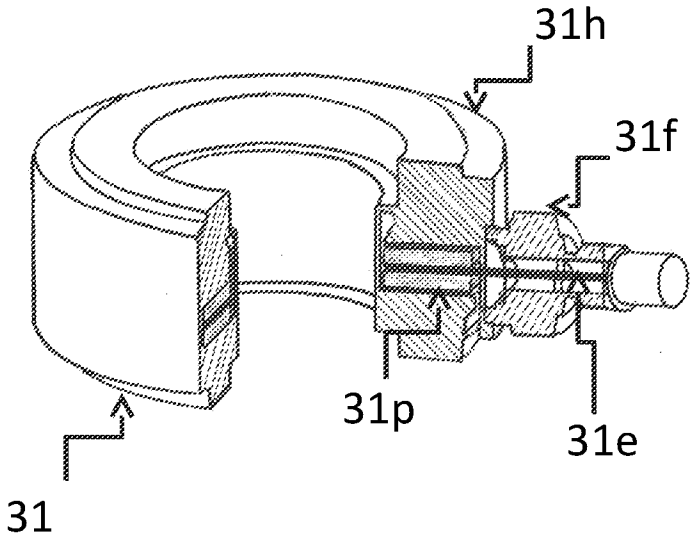
FIG. 4 is a perspective view, partially cut away, of a piezoelectric load cell and transducer, usable as a collar position sensor and provided for attachment to a dispenser tube of the nozzle assembly.

FIG. 4 is a perspective view, partially cut away, of a piezoelectric load cell and transducer which is usable as a collar position sensor 31*b* for attachment to a dispenser tube of the nozzle assembly. This type of load cell is known and is commercially available. The sensor 31*b* shown in FIG. 4 includes a toroidal housing 31*h*, a pair of annular piezoelectric elements 31*p*, a connector fitting 31*f*, and an electrode 31*e* extending radially outwardly from the piezoelectric elements.

The signal generated by the position of the collar member 14 on the nozzle spout 37 may be transmitted by pneumatic pressure, by hydraulic fluid, by an electronic position sensor which may be either wired or wireless. Optionally, the signal may be transmitted via fiber-optic cable.

This electronic signal is then used to automatically and efficiently determine a suitable fuel blend for that vehicle, out of a plurality of available fuel blends.

If the vehicle 200 requires a specific grade of gasoline or ethanol gasoline blend, the filler neck 13 in the vehicle is designed and configured to displace the collar member 14 on the nozzle spout 37 by a defined distance, corresponding to such grade or type of fuel or fuel blend.

Figure 5B:
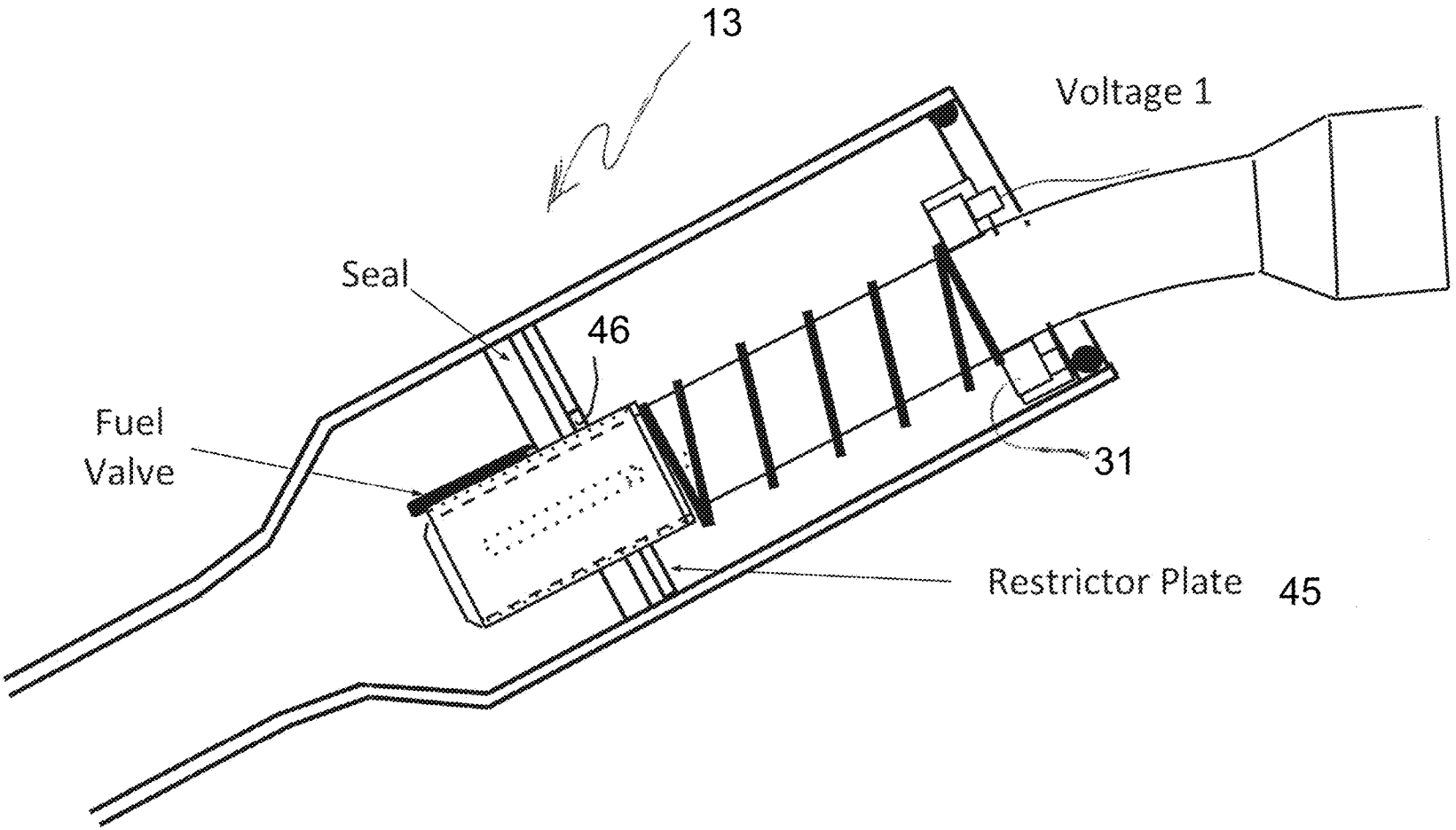
FIG. 5B is a cross-sectional view of a conventional fuel filler neck of a legacy vehicle, the fuel filler neck shown receiving a nozzle spout according to the system of the present invention therein, in which the collar member is not displaced but instead, passes through a restrictor of the fuel filler neck.

Referring now to FIGS. 3A and 5B, it will be seen that when the collar member 14 is in a first (non-retracted) position, aligned with and covering the tip of the nozzle spout 37, a first grade of fuel such as, for example, 10 percent ethanol is indicated and requested.

Figure 5C:
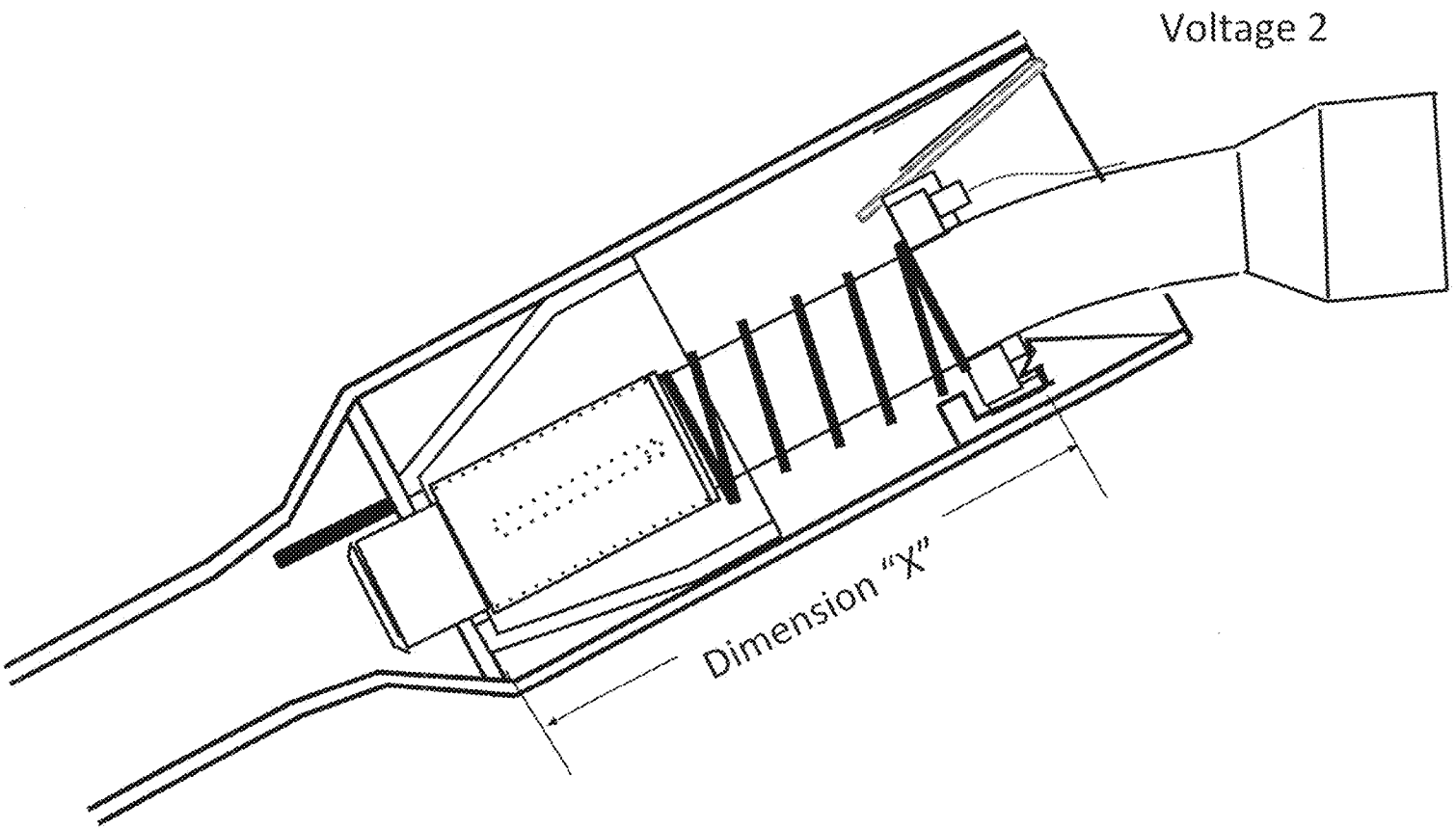
FIG. 5C is a cross-sectional view of a fuel filler neck assembly of a vehicle which is equipped with a first fuel filler neck according to the present invention, and which is configured to receive a first fuel blend according to the present invention, the filler neck receiving a nozzle spout therein according to the system of the present invention, in which the collar member is being displaced rearwardly on the nozzle spout by a first distance.

Referring again to FIG. 3A and also to FIG. 5C, when the collar member 14 is in a second position, displaced rearwardly from the tip of the nozzle spout 37 by a first distance $D_1$, a second grade of fuel such as, for example, 15 percent ethanol is indicated and requested.

Figure 5D:
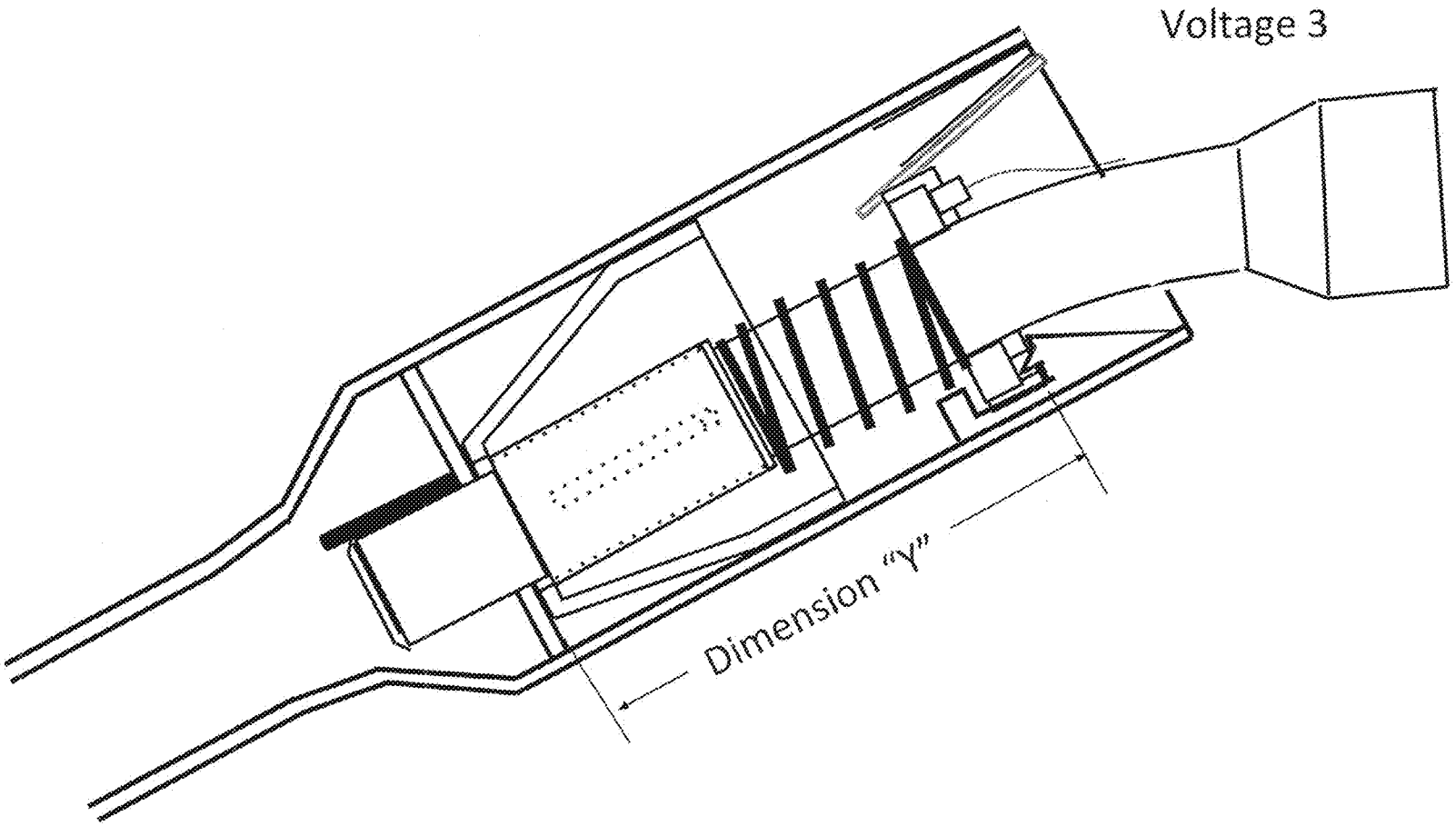
FIG. 5D is a cross-sectional view of a fuel filler neck assembly of another vehicle which is equipped with a second fuel filler neck according to the present invention, and which is configured to receive a second fuel blend according to the present invention, the filler neck receiving a nozzle spout therein according to the system of the present invention, in which the collar member is being displaced by a second distance greater than the first distance.

Referring again to FIG. 3A and also to FIG. 5D, when the collar member 14 is in a third position, displaced rearwardly from the tip of the nozzle spout 37 by a second distance $D_2$, which is greater than the first distance, a third grade of fuel such as, for example, 20 percent ethanol is indicated and requested.

Figure 5E:
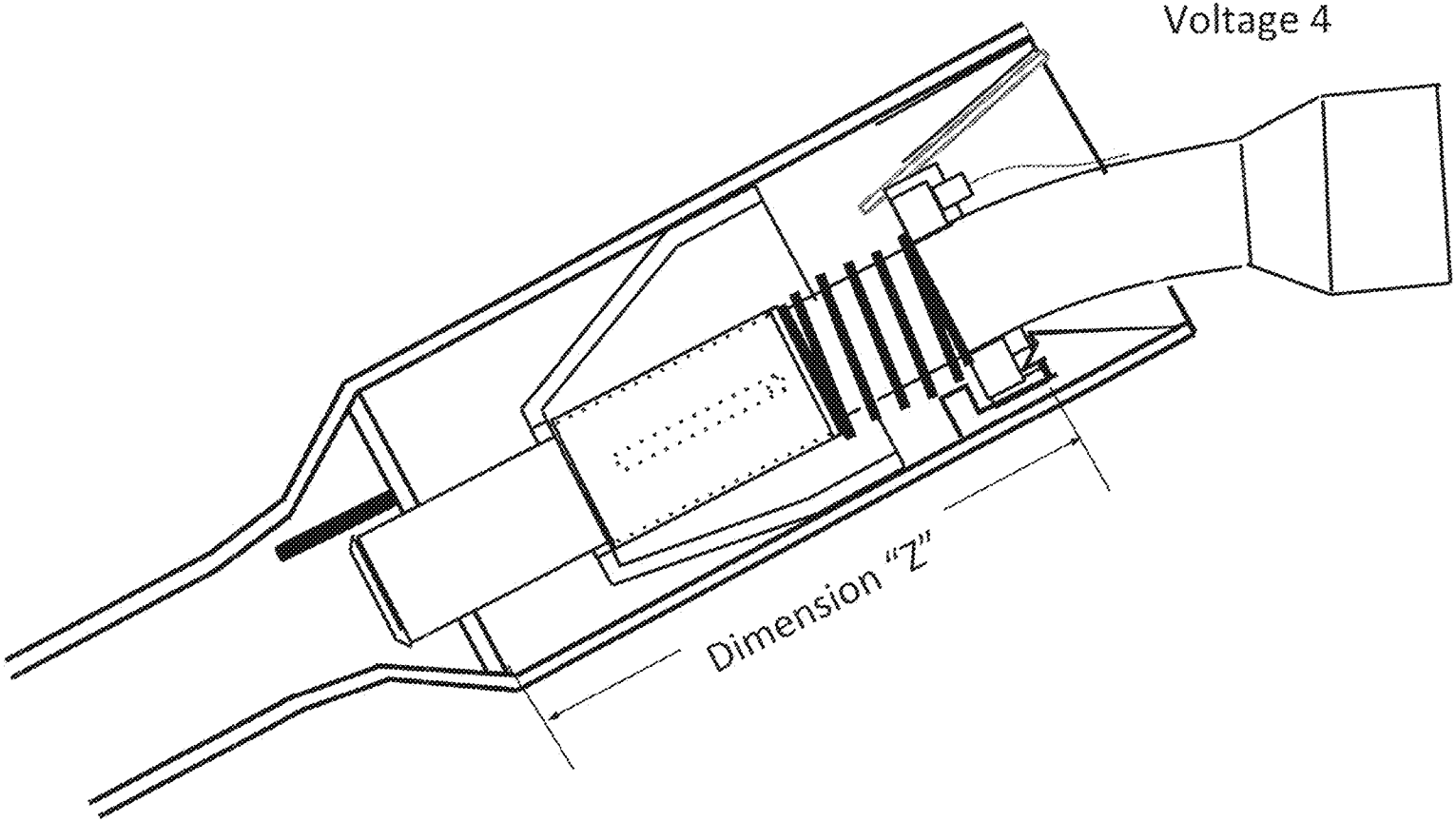
FIG. 5E is a cross-sectional view of a fuel filler neck assembly of still another vehicle which is equipped with a third fuel filler neck according to the present invention, and which is configured to receive a third fuel blend according to the present invention, the filler neck receiving a nozzle spout therein according to the system of the present invention, in which the collar member is being displaced by a third distance greater than the second distance.

Referring once again to FIG. 3A and also to FIG. 5E, when the collar member 14 is in a fourth position, displaced rearwardly from the tip of the nozzle spout 37 by a third distance $D_3$, which is greater than the second distance, a fourth grade of fuel such as, for example, 25 percent ethanol is indicated and requested.

FIG. 13 is a table showing a relationship between a distance that the collar moves on the nozzle spout and a selected fuel or fuel blend. The three different displacements of the filler neck restrictor and the locking channel are referred to in this document as X, Y and Z.

The displacement distances represented by X, Y and Z correspond to different fuels and/or fuel blends referred to as A, B and C.

A review of the table of FIG. 13, along with a careful review of FIGS. 3A and 5A-5E, along with the corresponding discussion herein, will increase understanding of the system and method of the present invention.

Although the examples described above refer to the use of different ethanol blends, it should be understood that the same system may be modified and adapted to select from regular, midgrade, and premium gasolines, or to select from other fuel choices, as needed.

Once a signal from the sensor is received by the pump computer 12, the pump computer then interprets this signal using preprogrammed software or firmware, and activates only the fuel or fuel blend corresponding to this signal, and deactivates all other fuels.

The vehicle operator is then free to begin pumping fuel into the vehicle 200, without having to manually select the appropriate grade fuel.

Fuel Filler Neck Assembly

One important aspect of this system for determining which fuel should be supplied to each vehicle lies in the design of the vehicle fuel filler neck assembly 13 as illustrated in FIG. 5A. This assembly includes of a cup-shaped filler neck restrictor member 45, with a restrictor orifice 46 disposed therein. The diameter of the orifice is just wide enough to allow the nozzle spout 37 to pass through it.

A fuel inlet valve, including a spring 47 and door 48, seals the orifice until the appropriate sized nozzle passes through the orifice and opens the door. The fuel inlet valve is attached to a fuel seal plate 49, which holds a circular seal 50 that prevents fuel vapors from escaping from the fuel tank when the fuel inlet valve is open.

When the fuel nozzle spout 37 is inserted in the filler neck assembly 13, it encounters an optional spring-loaded pivoting nozzle guide tab 51. As the nozzle spout 37 moves forward into the filler neck assembly, the tip of the spout is guided to the restrictor orifice 46 by the filler neck restrictor, and a locking flange 43 of the nozzle is guided toward the locking channel 53 by the inclined flange guide 52. The flange 43 eventually reaches the flange stop 54.

A curved slot 44 in the locking flange 43 is engaged by a pin or tooth 55 provided inside of the fuel filler neck 13. The curved slot allows the tooth to lock the entire nozzle assembly in place, even if it is rotated during or after insertion.

Meanwhile, the nozzle guide tab 51 is exerting a downward pressure on the nozzle spout 37, causing the flange 43 to drop into the locking channel. At the same time, the spring 35 is pushing the nozzle flange back, pushing the curved slot into the locking tooth 55, and thereby holding the nozzle in place in the fuel filler neck 13. This locking engagement prevents the spring from pushing the nozzle assembly 11 out of position relative to the fuel filler neck during refueling.

The outside diameter of the sliding collar member 14 is the same as that of today's nozzle spouts (19 mm), but is larger than the diameter of the nozzle spout to enable it to fit slidably thereon. The outside diameter of the sliding collar member 14 is also larger than the restrictor orifice 46 in the fuel filler neck 13 of a vehicle which requires a non-legacy fuel blend.

Because the collar 14 is too large to fit through the orifice, as the spout is pushed through the orifice, the sliding collar member is blocked by the restrictor plate and slides back rearwardly on the spout by a predetermined distance. Thus, once in place, the distance between the orifice of the fuel neck restrictor 45 and the back of the locking channel 53 displaces the sliding collar member 14 a precise amount, depending upon the location of the fuel neck restrictor within the fuel neck 56.

A signal, corresponding to the distance which the collar member is displaced, is then generated and sent to the control computer 12, thus activating a selection of the right fuel, in the fuel dispenser pump, for that specific vehicle.

System Operation

A motorist choosing to refuel a vehicle 200 will insert the nozzle spout 37 of the dispensing nozzle assembly 11 into the fuel filler neck 13 of the vehicle. If the orifice 46 formed in a restrictor 45 (see FIG. 5B) inside the fuel filler neck 13 has a diameter larger than an outside diameter of the sliding collar member 14, the collar member will pass through the orifice 46 of the restrictor, without moving rearwardly on the nozzle spout 37. As a result, a first signal is generated by the sensor 31*b* on the nozzle assembly 11, and this signal is transmitted to the control computer 12 of the pump base 24.

An algorithm in the fuel dispenser pump control computer 12 recognizes, from receipt of the first signal, that this vehicle is an older vehicle not equipped with a fuel filler neck designed to activate the selective dispensing nozzle system. The dispensing computer will then either automatically select, or will allow the motorist to select whatever fuels are appropriate for older vehicles, such as, for example, a blend of 10 percent ethanol and gasoline.

If, however, the vehicle being refueled is a newer model that requires a specific fuel, then the diameter of the opening in the restrictor plate will be smaller than the collar member diameter, but larger than the diameter of the nozzle spout. Thus, when the nozzle is inserted into the filler neck, the sliding collar member 14 will be displaced rearwardly, on the nozzle spout 37, by a specified distance corresponding to a fuel blend needed for that vehicle.

A spring-loaded pivoting nozzle guide tab 51 (FIG. 5*a*) guides the nozzle spout into the filler neck and pushes the flange 31 (FIG. 3*b*) into the channel 53. The force exerted by the spring on the spout 35 (FIG. 3*b*) engages the latching finger 55 (FIG. 5*a*) to secure the nozzle.

When the nozzle is correctly positioned, the sensor 31 will generate signal corresponding to the specified distance, and the dispensing computer 12 will select and activate fuel or fuel blend combination A, B or C. When this occurs, the motorist can begin the refueling process.

In the event that the fuel designator A, B or C represents multiple fuels and a choice between these fuels must be made, an algorithm in the dispensing computer will automatically select the lowest cost fuel, unless the motorist manually overrides this selection.

Method

Figure 6:
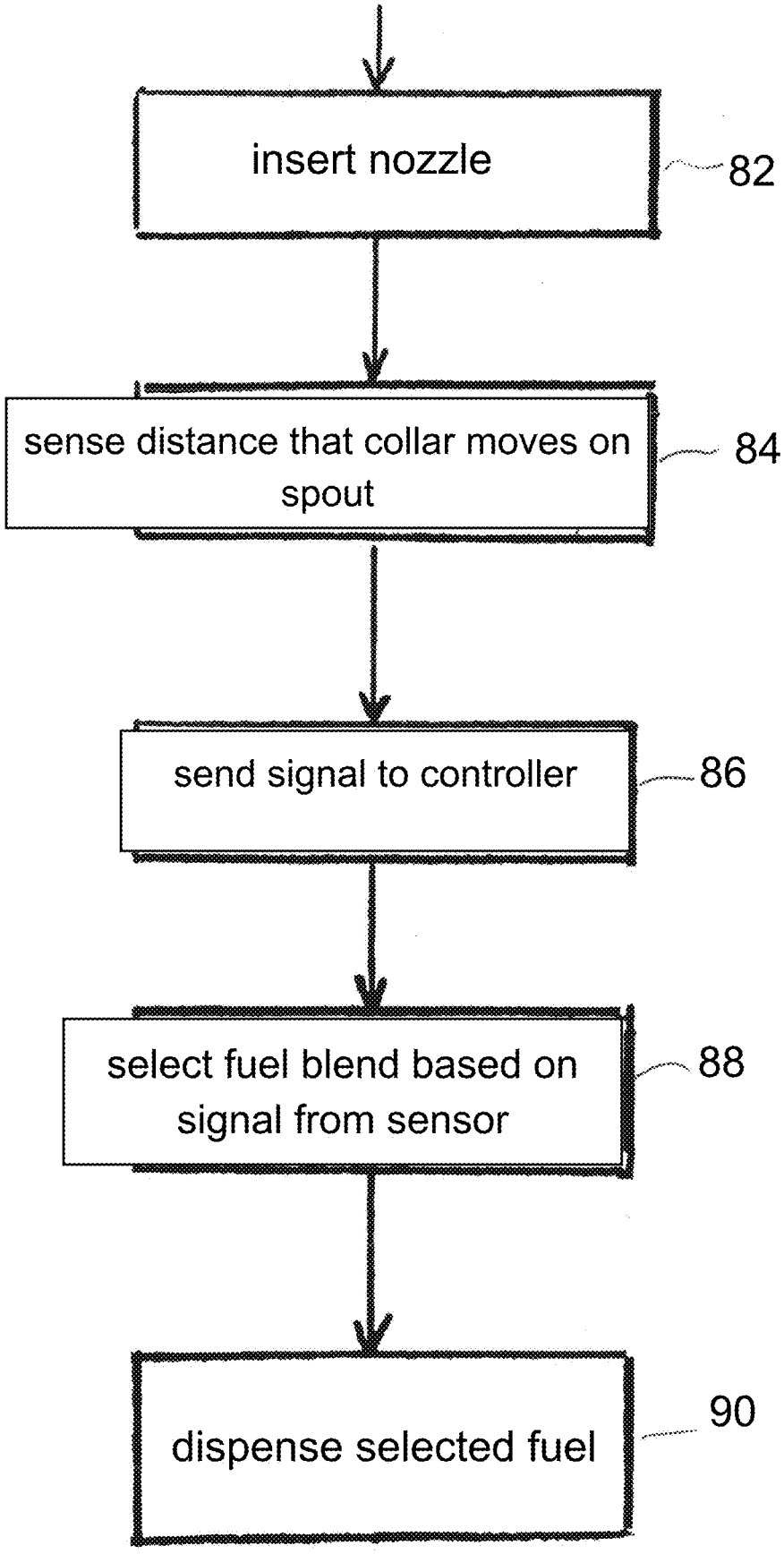
FIG. 6 is a flow chart showing steps in a method according to the present invention.

The present invention also contemplates a method of selecting a fuel or fuel blend to be dispensed into a vehicle. Steps in the method hereof are illustrated in FIG. 6.

The method according to the invention includes a first step of inserting a nozzle 11 of a dispensing pump 22 into a fuel filler neck 13 of a vehicle 200 having a restrictor member 45 therein with a orifice 46 formed in the restrictor member, and placing a tip portion of the nozzle into the orifice 46, whereby a collar 14 on the nozzle tip is displaced by a specified distance. This step is shown at 82 in the flowchart of FIG. 6.

The method according to the invention includes another step of sensing a distance which the collar 14 on the nozzle tip has moved on the fuel filler neck using a sensor 31*b*, and generating a signal based on a distance that the collar 14 has been displaced. This step is shown at 84 in the flowchart of FIG. 6.

The method according to the invention includes another step of sending the signal to a processor. This step is shown at 86 in the flowchart of FIG. 6.

The method according to the invention includes another step of evaluating the signal in the processor to determine an appropriate fuel or fuel blend for the vehicle 200, and selecting one of a plurality of fuel or fuel blends based on the signal received by the processor. This step is shown at 88 in the flowchart of FIG. 6.

The method according to the invention includes a final step of dispensing the selected fuel or fuel blend into the vehicle 200 through the nozzle 37. This step is shown at 90 in the flowchart of FIG. 6.

System Overview—Second Embodiment

A fuel delivery system 120 according to a second illustrative embodiment of the invention includes a fuel dispenser pump 122 including a pump base 124, a hose assembly 110 operatively attached to the pump base, and a nozzle assembly 111 affixed to a distal end of the hose assembly.

Figure 7:
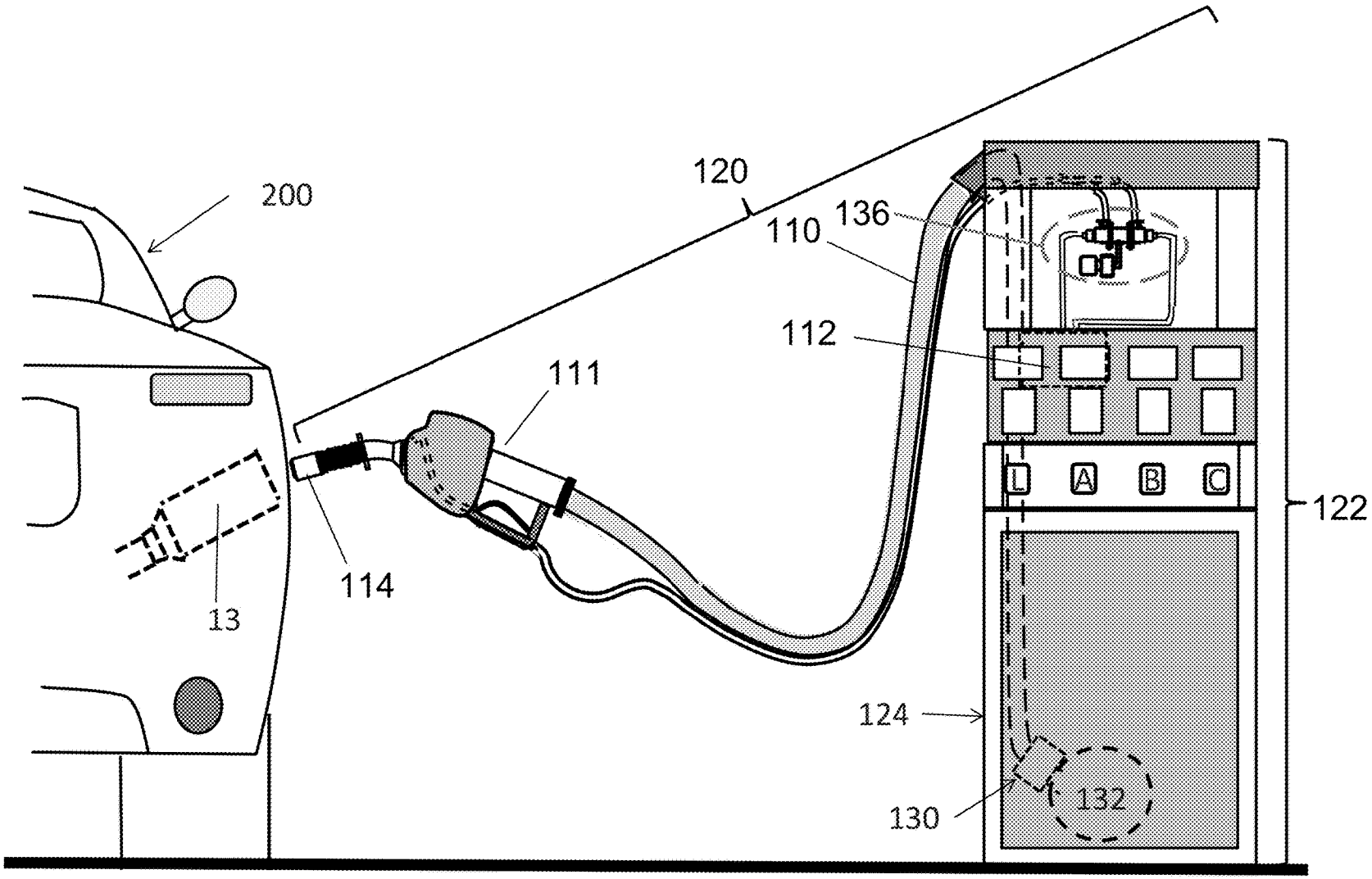
FIG. 7 is a side elevational view showing an overview of a fuel delivery system and pump assembly according to a second embodiment of the present invention, along with a vehicle ready to be refueled.

The system 120 hereof is designed to work in conjunction with a series of specialized filler necks, such as the one shown at 13 in FIG. 7, which are selectively and respectively installed in vehicles that are configured to work with the system.

A key component of the system 120 hereof is that a fuel-delivering nozzle spout 137 of the nozzle assembly 111, has a spring-loaded slidable collar member 114 disposed on a tip end thereof, and a position of the collar member on the nozzle, when used in conjunction with a calibrated fuel filler neck 13 on a vehicle 200 which is configured to work with the system hereof, is read by a sensor which sends a signal back to the pump base 124, and that signal is used to select an appropriate fuel for the vehicle, by a control computer 112 disposed in the pump base 124.

The signal, generated by the position of the collar 114 when the nozzle spout 137 is inserted into the filler neck 113, may be transmitted by pneumatic pressure or hydraulic fluid, or by an electronic position sensor which may be wired or wireless. Optionally, the signal may be transmitted via fiber-optic cable.

This electronic signal is then used to automatically and efficiently determine the proper fuel or fuel blend for that vehicle, out of a plurality of available fuels.

If a vehicle requires the use of a specific grade of gasoline or ethanol gasoline blend, the filler neck 13 is designed and configured to displace the collar member 114 on the nozzle spout 137 by a defined distance corresponding to such grade or type of fuel.

Where the signal is sent via air pressure, this displacement of the slidable collar member 114 causes the venting of one or more air pressure lines, which causes an associated air pressure switch, in the fuel dispenser pump, to deactivate an electrical line leading to the pump computer. The pump computer then interprets this signal, and activates only the fuel or fuel blend corresponding to this signal, and deactivates all other fuels. The vehicle operator is then free to begin pumping fuel without having to manually select the appropriate grade fuel.

In the second embodiment of the invention, in which the signal is sent via compressed air, the fuel dispenser pump 122 further includes a connector 130 for connecting to a source of pressurized air, which may either be a source external to the fuel dispenser pump 122, or alternatively, may be a compact compressor 132 housed inside of the pump base 124.

The fuel dispenser pump 122 also includes an electronic controller 112 configured to select an appropriate fuel, based on at least one signal received from the nozzle assembly 111.

In the depicted embodiment, the fuel dispenser pump additionally includes a signal converter 136, disposed inside of the pump base 124, for converting pneumatic signals to electronic signals. The signal converter 103 will be described in detail subsequently.

System Operation—Second Embodiment

An overview of the system according to the second embodiment is shown in FIG. 7. Within the fuel dispenser pump is a source of constant air pressure of approximately 60-100 psi. The source of this pressure can be an air compressor 132 within the pump 122 as shown in FIG. 7, or alternatively, the air source may be a station-wide system with a central compressor and lines running to each individual pump. The compressed air is stored in a constant pressure chamber 102 of a signal converter 103. At each end of the constant pressure chamber 102 are variable pressure chambers 104 and 105. There is a small orifice 117, 118 in a plate 115, 116 between the constant volume chamber and each variable pressure chamber that equalizes the pressure between the two chambers when the variable pressure chamber is not vented to the atmosphere, but this orifice is too small to keep the variable pressure chamber pressurized when it is vented.

Each of the variable pressure chambers 104, 105 has a vent line 108 and 109 that runs along the dispenser hose assembly 110 to the selective dispensing nozzle 111. Also, each variable pressure chamber 104, 105 is equipped with a low air pressure sensor 106 and 107 that closes and opens circuits depending on whether the variable pressure chambers are pressurized or vented. The circuits from the low air pressure sensors are wired or programmed into the fuel dispenser pump's control computer 112, which then selects the fuel or fuels that are acceptable in that particular vehicle.

The vent lines 108, 109 run from the signal converter 103 in the fuel dispenser pump 122 to the dispensing nozzle assembly 111, and are eventually sealed by a sliding collar member 114 on the nozzle spout 137. Small vent openings in this collar member 114 will vent either or both of the vent lines if the collar member is forced to slide back on the spout.

A motorist choosing to refuel their vehicle will insert the selective dispensing nozzle 137 into the fuel filler neck 13 of their vehicle. If the restrictor plate 48 inside the fuel filler neck has a diameter larger than that of the sliding collar member, the collar member will pass through the restrictor plate without moving. As a result, neither one of the variable air pressure chambers 104, 105 is depressurized, and both circuits remain closed. An algorithm in the fuel dispenser pump control computer 112 recognizes that this vehicle is an older vehicle not equipped with a fuel filler neck designed to activate the selective dispensing nozzle system. The dispensing computer will then allow the motorist to select whatever fuels are appropriate for older vehicles.

If, however, the vehicle being refueled is a model that requires specific fuels, then the diameter of the opening in the restrictor plate will be smaller than the collar member diameter but larger than the diameter of the nozzle spout. Thus, when the nozzle is inserted into the filler neck, the sliding collar member will be displaced back until an opening in the collar member aligns with the end of a vent line. When this occurs, one or both of the variable pressure chambers will be depressurized. Based on which vent lines are depressurized, the dispensing computer will select and activate either fuel or fuel combination A, B or C. When this occurs, the motorist can begin the refueling process. In the event that the fuel designator A, B or C represents multiple fuels, an algorithm in the dispensing computer will automatically select the lowest cost fuel, unless the motorist manually overrides this selection.

Signal Converter

Figure 8:
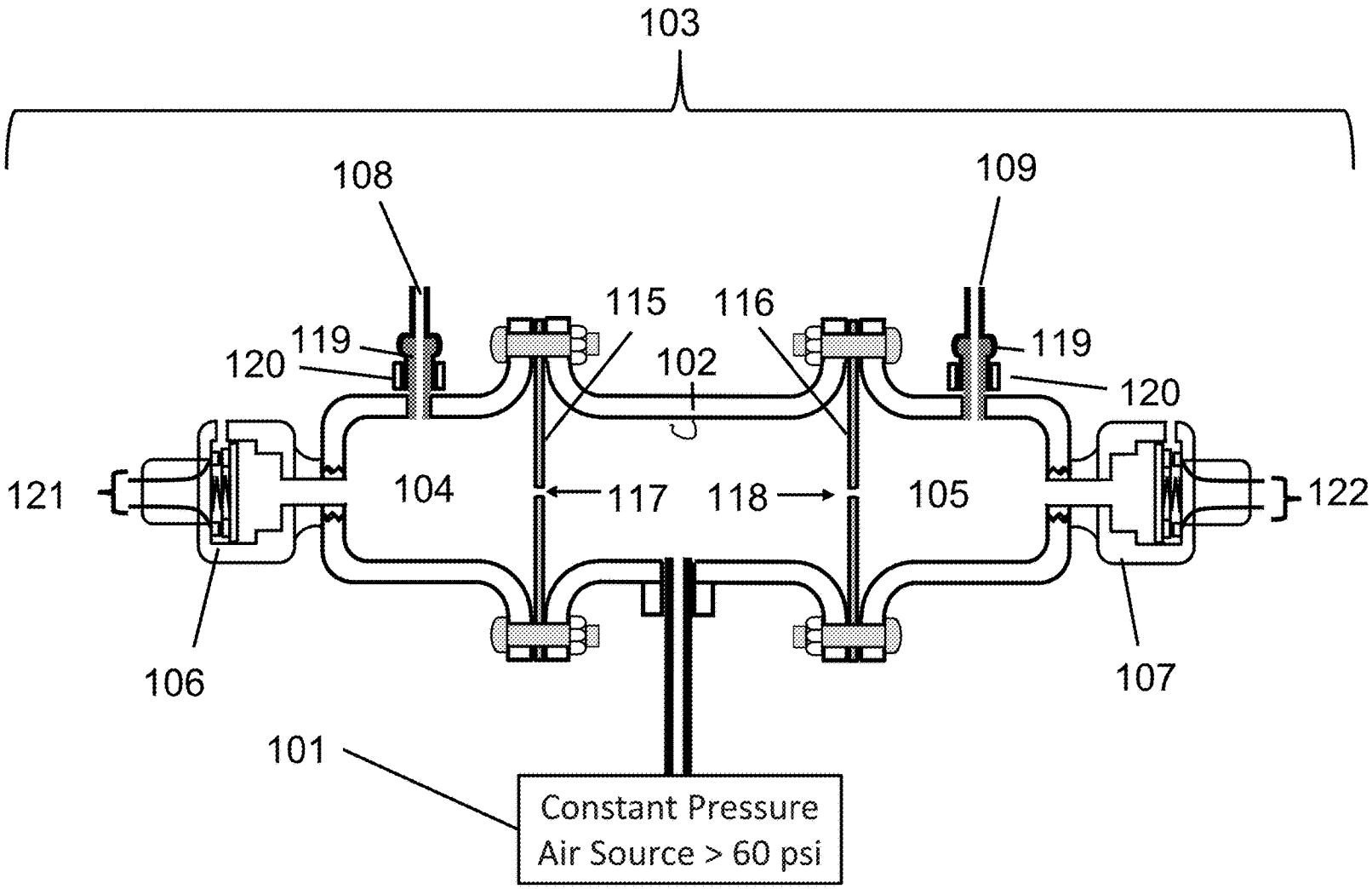
FIG. 8 is a cross-sectional view of a signal converter which is a component of the system of FIG. 7.

The signal converter 103 is shown in FIG. 8. A constant pressure air source 101 provides compressed air between 60-100 psi to the constant pressure chamber 102. Attached to the constant pressure chamber are a variable pressure chamber 104 for a first compressed air vent line 108, and a variable pressure chamber 105 for a second compressed air vent line 109. A pair of disc-shaped partitions 115 and 116 are provided inside of the signal converter. One of these partitions is disposed between each variable pressure chamber and the constant pressure chamber 102. Each partition 115, 116 has a small orifice 117, 118, respectively formed therein that allows a small volume of air to flow between the constant pressure chamber and the variable pressure chamber. This small volume of air flow has a number of functions, as described below.

1. It equalizes the air pressure in the variable pressure chambers to the pressure in the constant pressure chamber when the line leading to the variable pressure chamber is not vented to the atmosphere.
2. It compensates for air leaking from the nozzle assembly when the air line is sealed.
3. It ensures that the airflow in the lines is always from the dispensing pump where electricity is present to the nozzle where inflammable fumes are present, thus eliminating any potential backflow that could lead to gasoline fumes getting sucked into the dispensing pump; and
4. After refueling is complete and the nozzle is withdrawn from the filler neck, it re-pressurizes a variable pressure chamber that was depressurized during the refueling event.

Coming out of each variable pressure chamber is a respective air pressure vent line 108 and 109 that runs down the dispenser hose assembly 110 and through the dispenser nozzle assembly 111 to the nozzle spout 137. A sliding collar member 114 on the spout 137 either keeps the end of the air line sealed, or vents it to the atmosphere, depending on how far along the axis of the nozzle spout the collar member is displaced.

Since the diameter of the air line is larger than the diameter of the orifice 117 and 118, when the air line is vented, more air leaves the variable pressure chamber through the air line than the orifice will allow in. As a result, the air pressure in the variable pressure chamber will drop to nearly atmospheric.

Figures 9A, 9B:
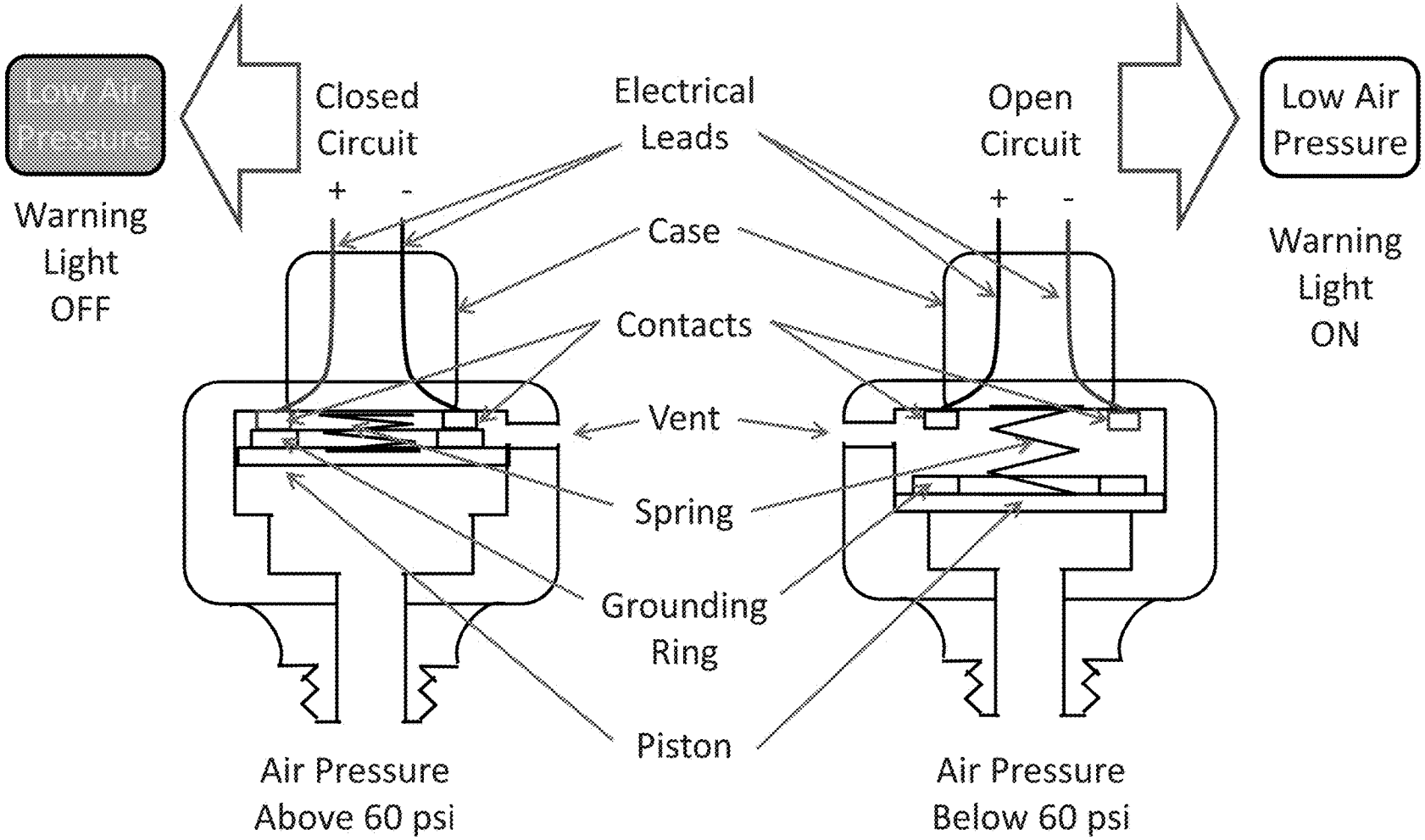
FIG. 9A is a first cross-sectional view of a pressure sensor which is usable as a sub-component of the signal converter of FIG. 8, shown in a pressurized state.
FIG. 9B is a second cross-sectional view of the same pressure sensor shown in a low-pressure state.

Attached to each variable pressure chamber is a commercially available low air pressure sensor for example, such sensors are used in truck air brake systems. A typical air sensor is shown in FIG. 9. Such sensors are designed to detect when there is a loss of air pressure in the braking system.

In the same way, when the air pressure in the variable pressure chamber approaches atmospheric, the circuit opens and the fuel dispenser pump control computer calculates which fuel or fuels are acceptable for the vehicle being refueled.

Figures 10A, 10B:
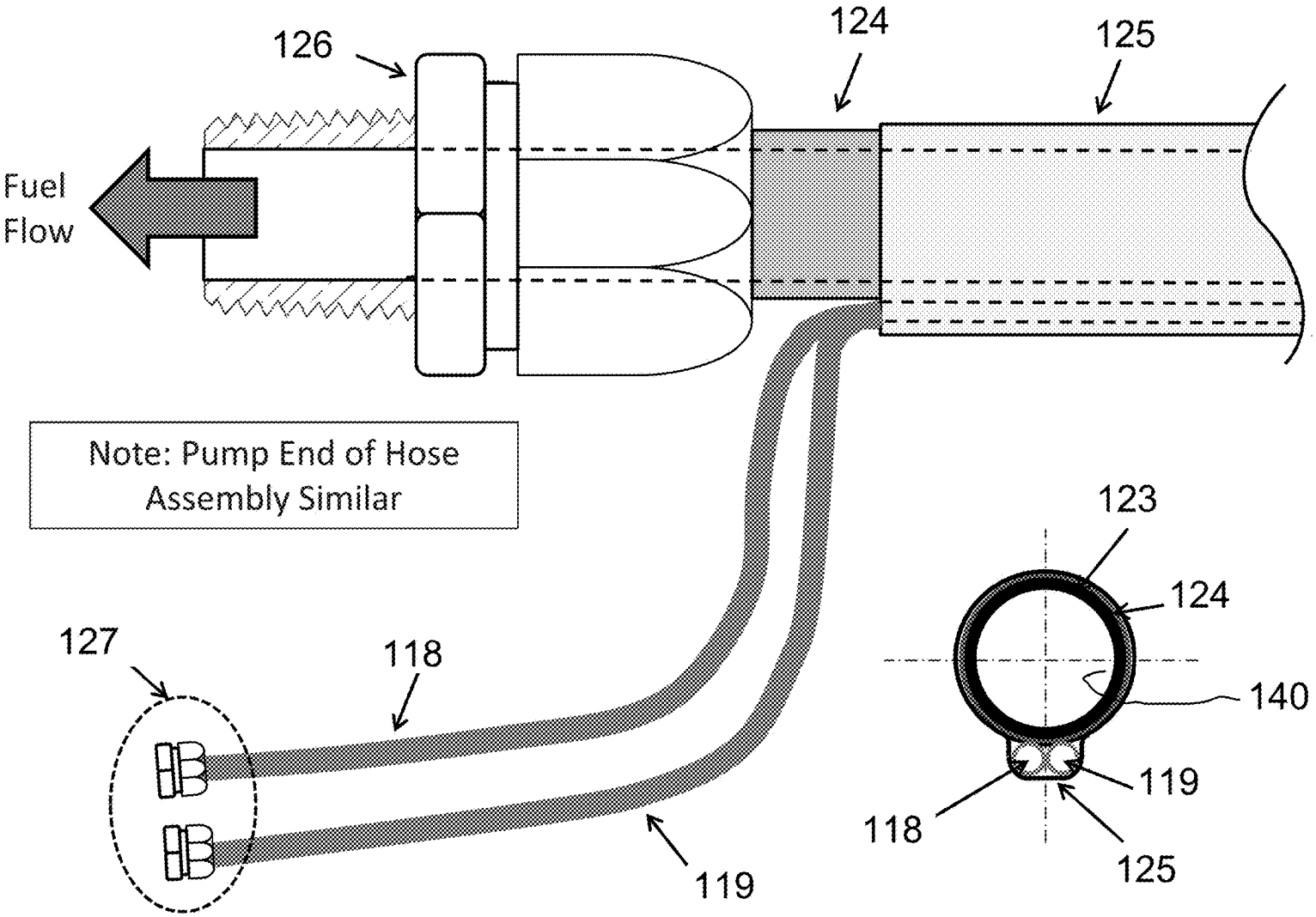
FIG. 10A is a detail side plan view of a dispenser hose assembly which is another component of the system of FIG. 7.
FIG. 10B is a cross-sectional view of the dispenser hose assembly of FIG. 10A.

Referring also to FIG. 10, the hose assembly 110 includes a main fuel supply hose 123 which has a hose fuel channel 140 extending therethrough, and two hose compressed air channels 118, 119 extending therethrough, these compressed air channels being separate from one another and from the hose fuel channel. These hose compressed air channels 118, 119 may either be disposed inside or outside of the main fuel supply hose 123. Optionally, the hose assembly 110 may also include an external sleeve 125 surrounding the main fuel supply hose 123 and the compressed air channels 118, 119. A suitable connector 126 is provided on each end of the hose assembly 110.

A key component of the system 120 is that a fuel delivery nozzle 137 has a spring-loaded slidable collar member 114 on a tip end thereof, and a position of the collar member, when used in conjunction with a calibrated fuel filler neck 13 on a vehicle 200 which is configured to work with the system hereof, sends a pneumatic signal which is used to automatically and efficiently determine the proper fuel or fuel blend for that vehicle, out of a plurality of available fuels.

Dispenser Hose Assembly

The dispenser hose assembly 110, shown in FIG. 10, connects the fuel dispenser pump 122 to the nozzle assembly 111. The hose assembly runs from the dispensing pump and connects to the nozzle via a hose fitting 126. The various vehicle fuels run though the fuel hose 123 as is typical with a conventional fuel hose assembly. A protective layer 124 covers the fuel hose. The two air pressure lines 118 and 119, connected to the signal converter 103 at the dispensing pump 122, are also attached to the lower section of the fuel hose protective covering 124. Each of the air pressure lines 118 and 119 is respectively connected to the fuel nozzle assembly 111 with pressure-sealing connectors 127. The entire hose assembly 110 may be covered by a second protective covering 125.

Nozzle Handle to Nozzle Spout Connections

Figure 11:
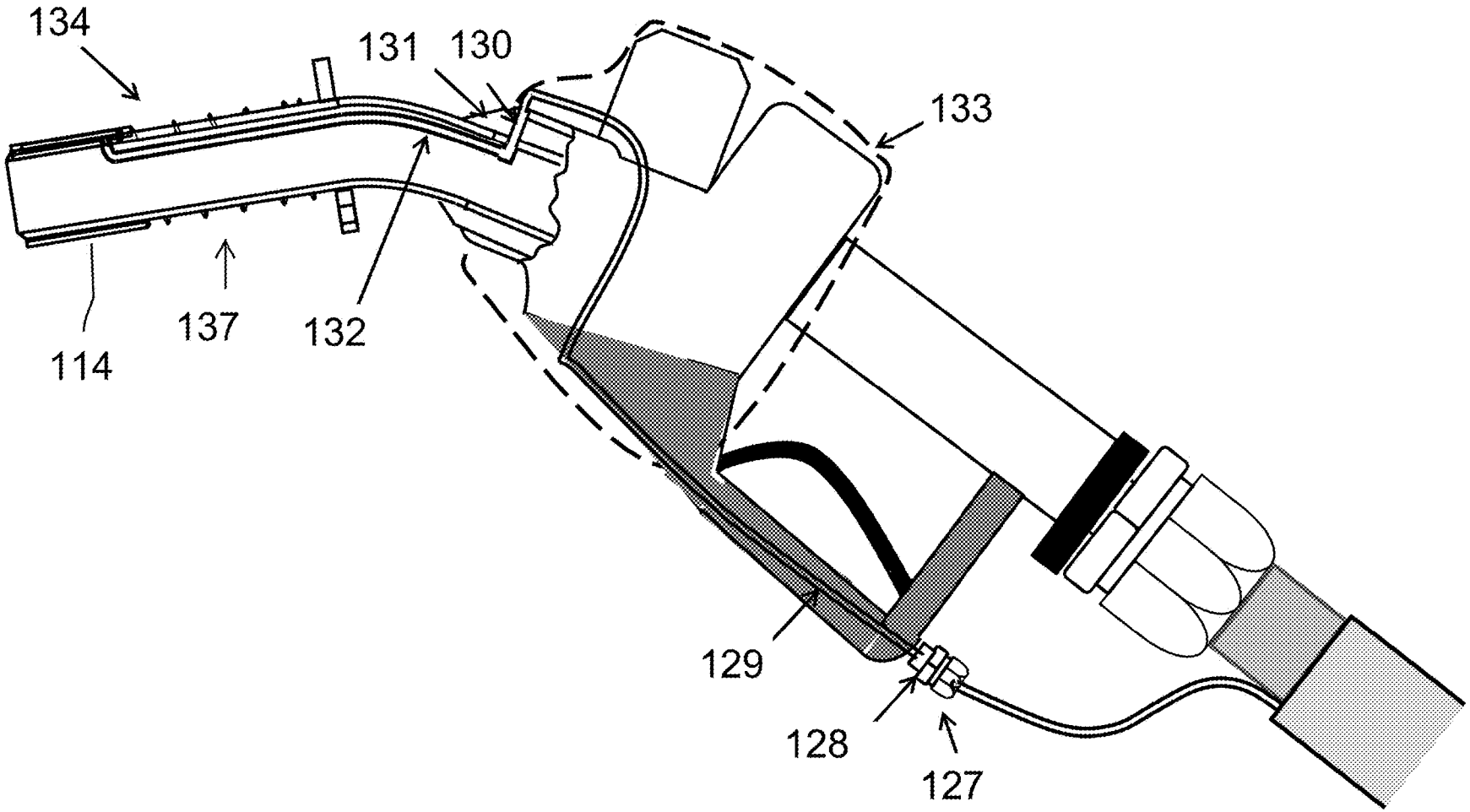
FIG. 11 is a detail view, partially in cross-section, of a nozzle assembly which is another component of the system of FIG. 7.

FIG. 11 illustrates the pathway for the air pressure lines from the base of the dispenser nozzle handle to the nozzle spout. The female connectors 127 from the air pressure lines in the hose assembly are connected to male connectors 128 from the nozzle air pressure lines 129 that travel through the nozzle handle and under the plastic nozzle cover 133 and to the spout line connector 130.

The nozzle air pressure lines could be a combination of flexible lines, metal lines and passages within the body of the nozzle itself.

Ultimately, the nozzle air pressure lines connect with the spout air pressure lines 132 that are internal to the nozzle spout itself.

Nozzle Spout

Figures 12A, 12B, 12C:
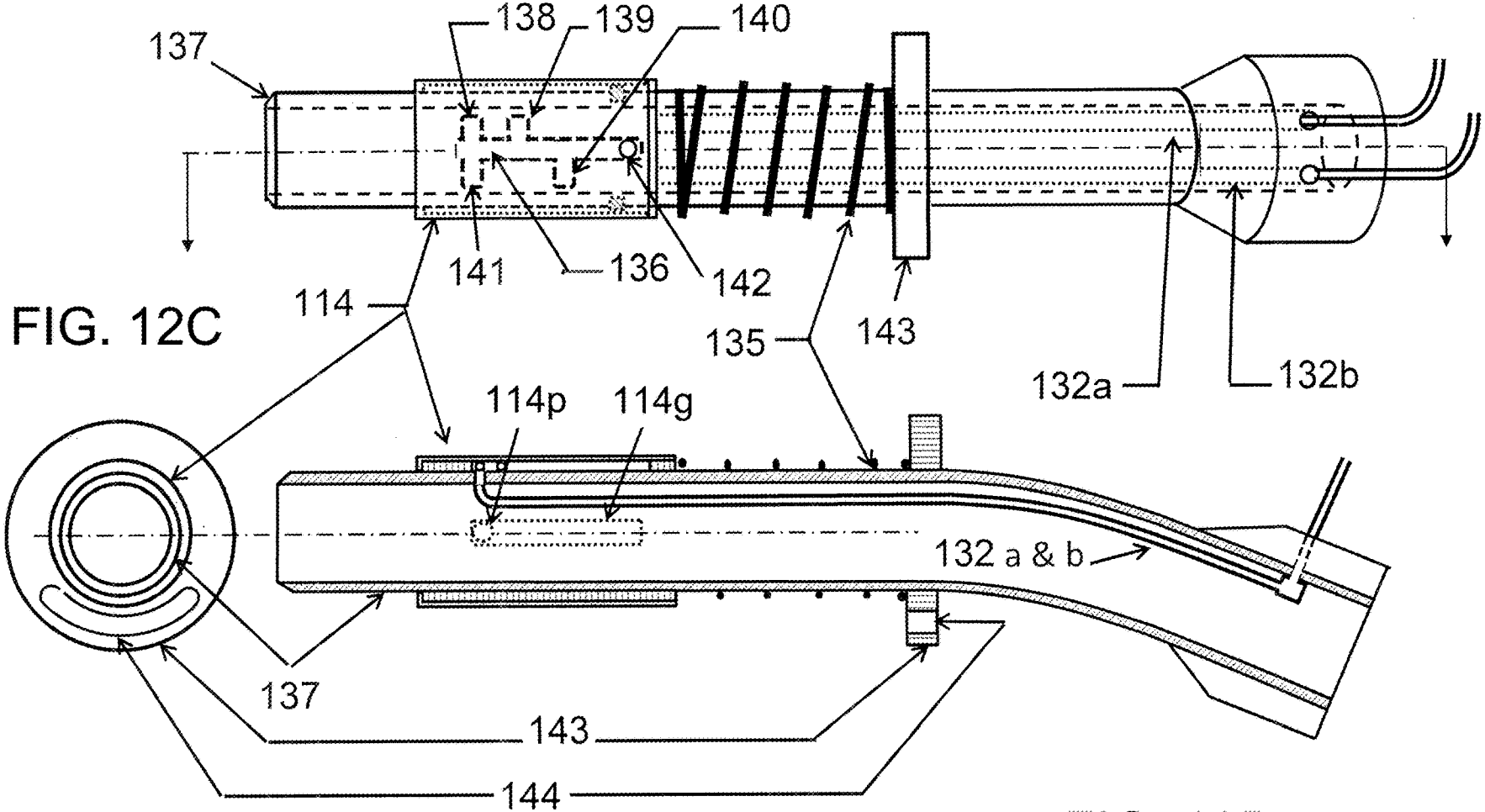
FIGS. 12A-12C are a top plan view, a longitudinal cross-sectional view, and an end plan view of a nozzle spout, which is a part of the nozzle assembly of FIG. 11.

FIG. 12 illustrates components of the nozzle assembly 111 that convert the displacement of the sliding collar member 114 into a series of binary pneumatic signals.

Two air pressure lines 132*a* & 132*b* are inside the nozzle spout and exit the spout beneath the collar member 114. When the exit of either or both air pressure lines 132*a*, 132*b* are covered by a solid part of the sliding collar member, the line is effectively sealed and pressurized.

The collar member spring 135, extending between the collar member and a locking flange 143, exerts a force on the collar member away from the flange. During assembly of the nozzle spout 137, the collar member spring 135 is placed on the spout followed by a collar core 114 *a*. the collar core has a network of slots that, when the collar cover 114*b* is attached, form vent channels. The central channel 136 runs parallel to the centerline of the nozzle spout to a vent hole 142 in the collar cover. Four connecting vent channels (138, 139, 140, 141) run perpendicular to the central channel. The collar core 114*a* is forced back compressing the spring 135 until the guide channels in the collar core 114*a* align with the holes in the side of nozzle spout 137 in which the restraint pins 114*p* are inserted.

These pins then prevent the collar member from being forced off the spout. When the collar core 114*a* is in position, the collar cover 114*b* is pressed over the core and the vent opening 142 in the collar cover is aligned over the central vent channel 136 in the collar cover 144*b*. The combined assembly is called the sliding collar 114.

When the nozzle spout 137 is inserted into the corresponding fuel filler neck 13 of a vehicle, the sliding collar member 114, which slides on the nozzle spout 137 through which the fuel flows into the vehicle, is displaced a discrete distance that corresponds to the fuel requirements of the vehicle. The collar member displacement will cause one or more of four vent passages 138-141 in the collar core to align with the open end of either or both of the air pressure lines, causing that line or lines to vent to atmosphere. When this occurs, the air pressure throughout the line or lines drops to zero. At the same time, the low air pressure switches in the dispensing pump sense the pressure drop, opening electrical circuits connecting the low air pressure switches to the dispensing pump control computer. The opened circuits are detected by an algorithm in the computer software which then selects the fuel that is appropriate for that vehicle.

A curved slot 144 in the locking flange 143 is engaged by a tooth provided inside of the fuel filler neck assembly 13. The curved slot allows the tooth to lock the entire nozzle assembly in place even if it is rotated upon insertion.

Fuel Filler Neck Assembly

One important aspect of this system for determining which fuel should be supplied to each vehicle lies in the design of the vehicle fuel filler neck assembly 13 as illustrated in FIG. 5A. This assembly consists of a cup-shaped filler neck restrictor 45 with a restrictor orifice 46. The diameter of the orifice is just enough to allow the nozzle spout 137 to pass through it. A fuel valve assembly consisting of a spring 47 and door 48 seals the orifice until the appropriate sized nozzle passes through the orifice and opens the door. The fuel valve is attached to the fuel seal plate 49 which holds a circular seal 50 that prevents fuel vapors from escaping from the fuel tank when the fuel valve is open.

When the fuel nozzle spout 137 is inserted in the filler neck assembly 13, it encounters an optional spring-loaded pivoting nozzle guide tab 51. As the nozzle spout 137 moves forward into the filler neck assembly, the tip of the spout is guided to the restrictor orifice 46 by the filler neck restrictor, and the locking flange 143 of the nozzle is guided toward the locking channel 53 by the inclined flange guide 52. The flange eventually reaches the flange stop 54. Meanwhile, the nozzle guide tab 51 is exerting a downward pressure on the nozzle spout 137, causing the flange to drop into the locking channel. At the same time, the collar member spring 35 is pushing the nozzle flange back, pushing the curved slot into the locking pin or tooth 55, and thereby holding the nozzle in place in the fuel filler neck 13.

The outside diameter of the sliding collar member 114 is that of today's nozzle spouts (19 mm), but larger than the diameter of the nozzle spout and restrictor orifice in this design. Therefore, as the spout is pushed through the orifice, the sliding collar member is blocked by the restrictor plate and slides back on the spout. Thus, once in place, the distance between the orifice of the fuel neck restrictor 45 and the back of the locking channel 53 displaces the sliding collar member 114 a precise amount, depending upon the location of the fuel neck restrictor within the fuel neck 56. Depending on how far back the collar member is displaced, one or both of the air pressure lines are vented to atmosphere and the air pressure the vented line or lines drops to zero, thus activating the low air pressure switches in the fuel dispenser pump.

The three different displacements of the filler neck restrictor and the locking channel are referred to in this document as X, Y and Z. X, Y and Z correspond to different fuels and/or fuel blends referred to as A, B and C.

System Operation

When the owner of a vehicle not designed with a special fuel filler neck assembly a legacy vehicle, the collar member spring exerts enough force to keep the sliding collar member from moving as the nozzle is inserted into the vehicle, as shown in FIG. 8.

Since the slide collar member is not displaced, neither air pressure line is lined up with a vent channel in the collar member; therefore, the lines are sealed and pressurized.

Because both lines are pressurized, both low air pressure switches in the pump are in the closed position, and the dispensing pump computer recognizes this as signifying a legacy vehicle, and this allows the person doing the refueling to select from those fuels that the vehicle is capable of running on.

If the vehicle is a new vehicle designed to operate on a specific fuel and the fuel neck restrictor, seal plate and fuel valve are at the maximum possible depth inside the filler neck assembly, then the distance from the restrictor orifice and back of the locking channel will be at dimension X, this displacing the sliding collar member back just enough to vent air pressure line 132*b* through vent channel 140. Air pressure switch 107 at the fuel dispenser pump opens and the fuel dispenser pump computer activates the fuel or fuel blend called fuel "A", which is best suited for the vehicle. Thus, a person with this type of vehicle is freed from the task of selecting a fuel before beginning the refueling process.

Figure 14A:
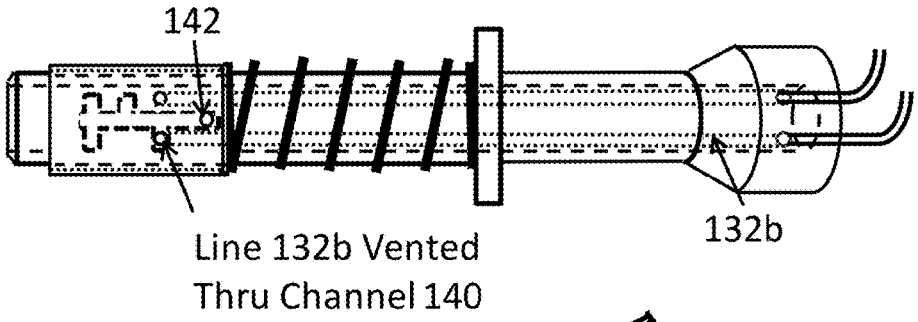
FIG. 14A is a cross-sectional view of a fuel filler neck assembly configured to receive a first non-conventional fuel designated as fuel "A", with a restrictor situated in a first position in the filler neck and with the nozzle hereof inserted therein.
Figure 14B:
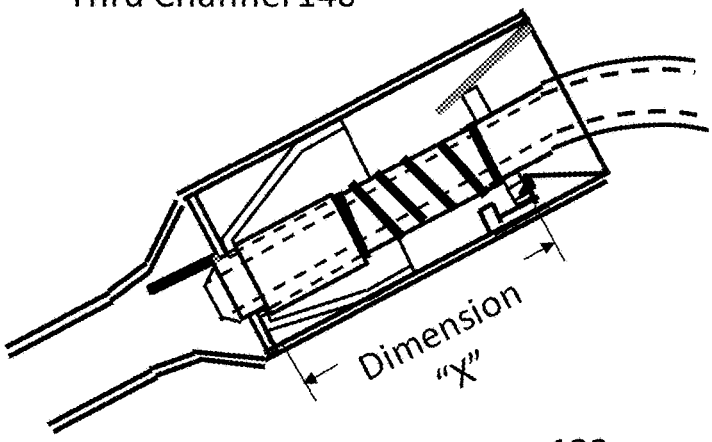
FIG. 14B is a top plan view of the fuel filler neck assembly, showing a position of a sliding collar member on the nozzle when used with the fuel filler neck of FIG. 14A.

FIGS. 14A-14B illustrate the position of the filler neck restrictor, nozzle spout and sliding collar member for a vehicle being refueled with fuel A.

FIG. 14B illustrates what occurs when the fuel neck restrictor is in a first retracted position dimension X. In this configuration, the sliding collar member vents air pressure line 132*b* through an associated vent opening, and the computer allows the use of fuel blend A.

Figure 14C:
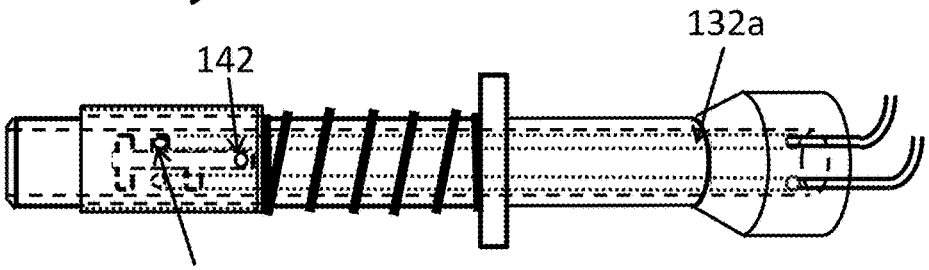
FIG. 14C is a cross-sectional view of a fuel filler neck assembly configured to receive a second non-conventional fuel designated as fuel "B", with a restrictor situated in a second position in the filler neck which is higher than the first position and with the nozzle hereof inserted therein.
Figure 14D:
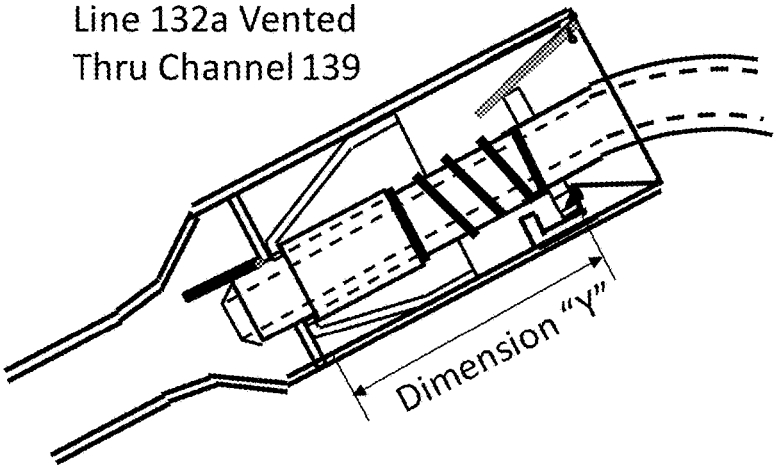
FIG. 14D is a top plan view showing a position of a sliding collar member on the nozzle when used with the fuel filler neck of FIG. 14C.

FIGS. 14C-14D illustrate the position of the filler neck restrictor, nozzle spout and sliding collar member for a vehicle being refueled with fuel blend B.

FIGS. 14C-14D illustrate what occurs when the fuel neck restrictor is in an intermediate position dimension Y. In this configuration, the sliding collar member vents air pressure line 132*a* through vent channel 139 and the computer allows the use of fuel B.

Figure 14E:
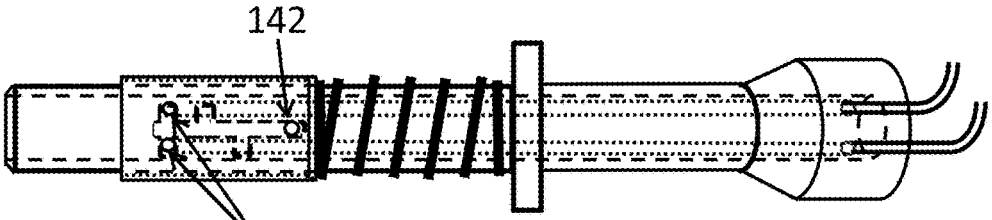
FIG. 14E is a cross-sectional view of a fuel filler neck assembly configured to receive a second non-conventional fuel designated as fuel "C", with a restrictor situated in a second position in the filler neck which is higher than the first position and with the nozzle hereof inserted therein.
Figure 14F:
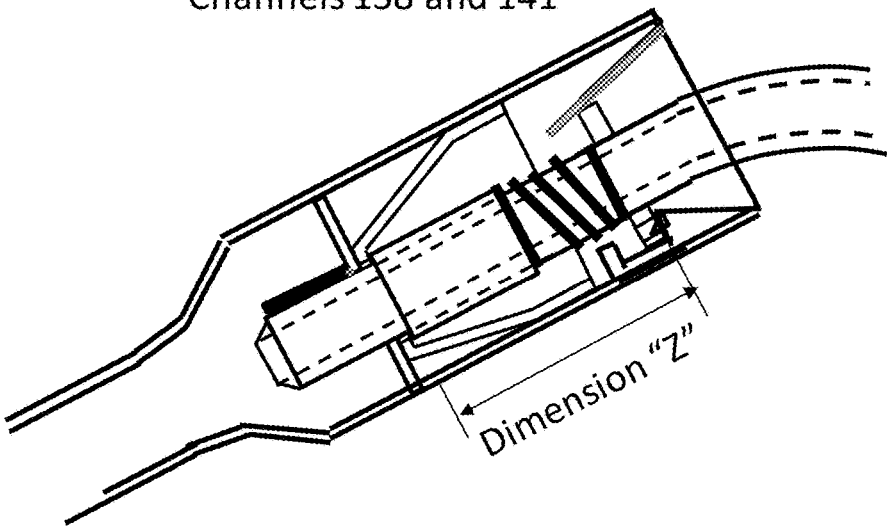
FIG. 14F is a top plan view showing a position of a sliding collar member on the nozzle when used with the fuel filler neck of FIG. 14E.

FIGS. 14E-14F illustrate the position of the filler neck restrictor, nozzle spout and sliding collar member for a vehicle being refueled with fuel blend C.

FIGS. 14E-14F illustrate what occurs when the filler neck restrictor is closest to the entry of the filler neck assembly dimension Z. In this position, both lines 32*a* and 32*b* are vented through vent channels 138 and 141. In this position, the computer allows the vehicle to be refueled with fuel blend C.

Precision Blending System

Some of the alternative high octane fuels under consideration involve adding more ethanol to the regular grade gasoline, which is typically already 10% ethanol. If higher ethanol or other non-petroleum fuels are blended with gasoline and those blends are to be sold through the same hose and nozzle as today's regular and premium, as consumers today expect, an additional feature would need to be added to the hose assembly—precision blending system. This system ensures that the concentration of the ethanol or other non-petroleum fuel in the fuel pumped into the car is unaffected by the residual fuel in the hose from the previous refueling event. The system is illustrated in FIG. 12.

Figure 15:
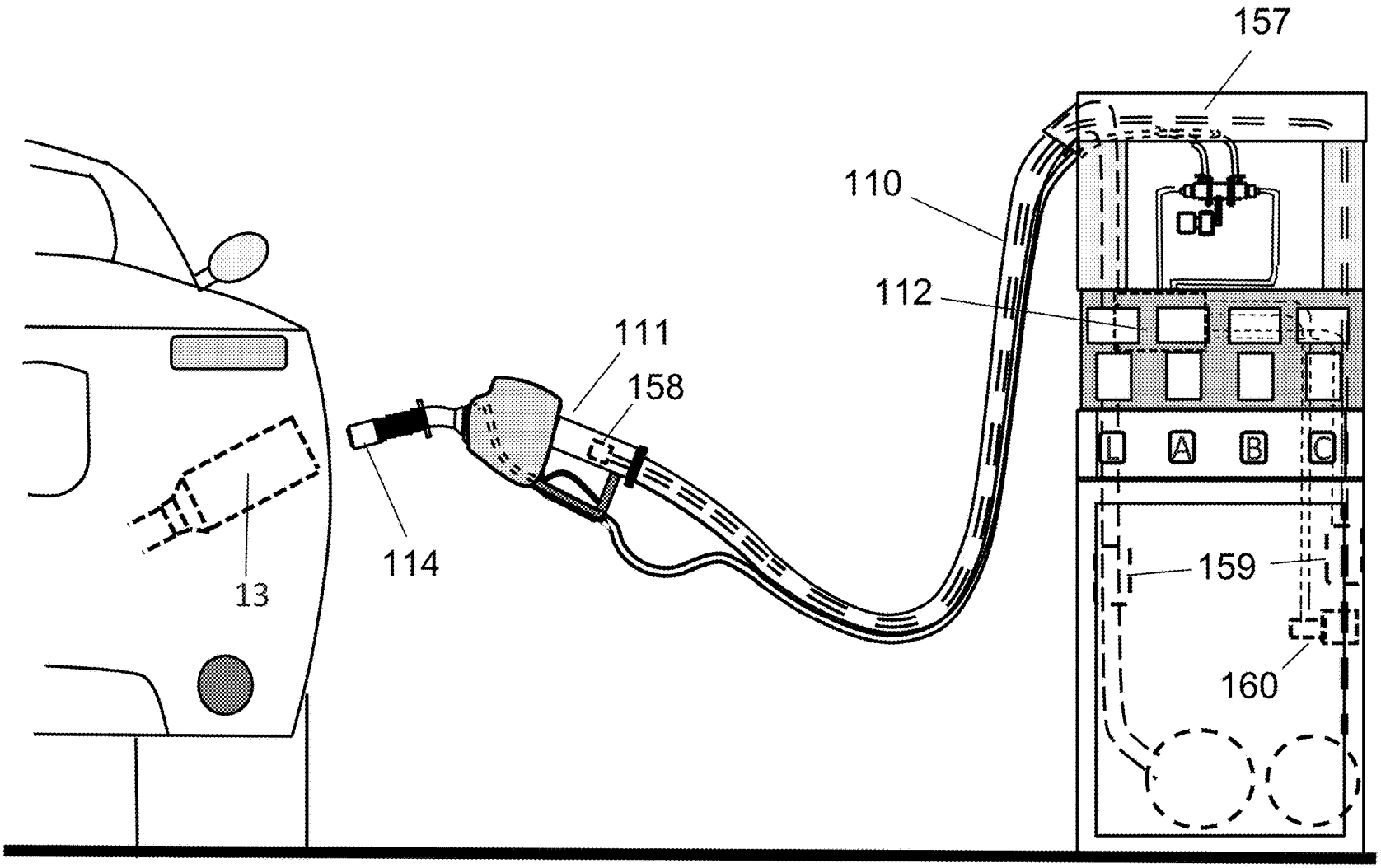
FIG. 15 is a side plan view showing an overview of a system according to a third embodiment of the present invention, along with a vehicle ready to be refueled.

The hose assembly shown in FIG. 15 differs from the standard hose assembly in the following ways:

1. The diameter of the outer gasoline hose 110 is slightly larger.
2. A smaller hose 157 snakes through the interior of the larger hose and terminates inside the nozzle assembly 111.
3. A small valve 158 at the nozzle end of the ethanol hose 157 opens when pressure in the hose rises and closes when the ethanol in the hose is not pressurized.
4. An additional flow meter 159 measures the amount of ethanol that is being added to the gasoline and coveys that information to the computer.
5. A computer controlled valve 160 regulates the flow of ethanol to match the flow of gasoline, thus assuring that when the two streams mix in the nozzle, the percentage of ethanol in the fuel is correct.

Figure 16:
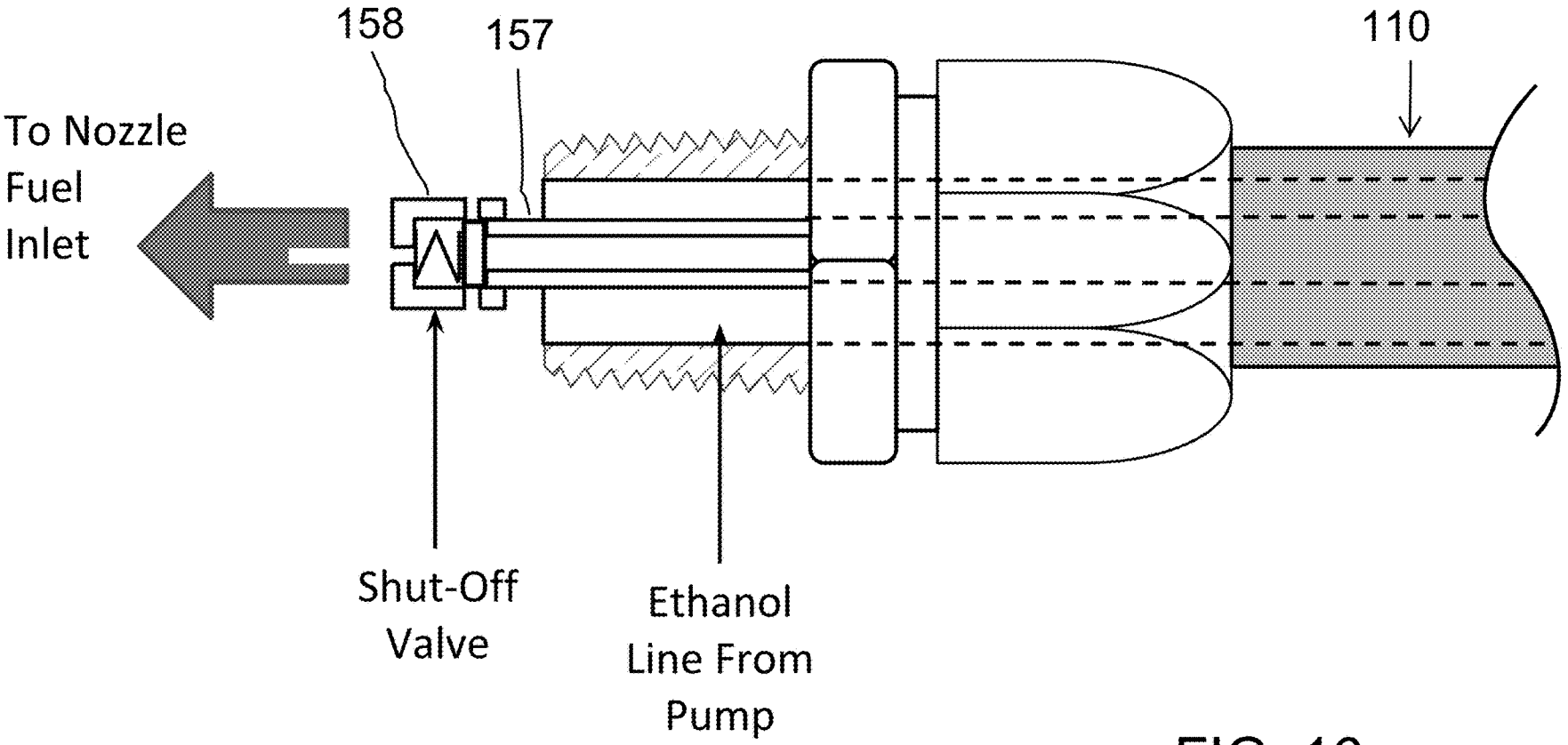
FIG. 16 is a cross-sectional view of an ethanol injection device, which is usable as a component of the system of FIG. 15.

At the nozzle end of the hose assembly shown in FIG. 16, ethanol flowing through the internal ethanol hose 157 terminates at a check valve 158. When the pressure in the ethanol hose is positive, the valve opens and the ethanol is emitted from small openings in the side of the valve assembly. This ethanol or other fuel mixes with the gasoline flowing through the gasoline hose 110. The resulting fuel mixture is then pumped into the vehicle fuel filler neck assembly 13.

At the fuel dispenser pump, the smaller ethanol (or other fuel) line exits the pump hose and then runs to the flow valve, flow meter and ethanol pump.

Although the present invention has been described herein with respect to a number of specific embodiments, the foregoing description is intended to illustrate, rather than to limit the invention. Those skilled in the art will realize that many modifications of the disclosed embodiments could be made which would be operable. All such modifications, which are within the scope of the claims, are intended to be within the scope and spirit of the present invention.

Reference Number Listing

| | |
|---|---|
| 10 | hose assembly |
| 11 | nozzle assembly |
| 12 | electronic controller |
| 13 | fuel filler neck assembly |
| 14 | sliding collar |
| 14a | collar core |
| 14b | collar cover |
| 14g | guide channel |
| 14p | restraint pin |
| 20 | fuel delivery system |
| 22 | fuel dispenser pump assembly |
| 24 | pump base |
| 31 | sensor and flange assembly |
| 31a | locking flange |
| 31b | load sensor |
| 31e | electrode |
| 31f | connector fitting |
| 31h | toroidal housing |
| 31p | piezoelectric element |
| 34 | nozzle body |
| 35 | collar spring |
| 37 | nozzle spout43 locking flange on nozzle spout |
| 45 | restrictor and nozzle guide |
| 46 | restrictor orifice |
| 47 | spring |
| 48 | door |
| 51 | guide tab |
| 52 | inclined flange guide |
| 53 | locking channel |
| 54 | flange stop |
| 55 | locking tooth |
| 101 | constant pressure air source |
| 102 | constant pressure air chamber |
| 103 | signal converter |
| 104 | variable pressure chamber |
| 105 | variable pressure chamber |
| 106 | low air pressure sensor |
| 107 | low air pressure sensor |
| 108 | vent line |
| 109 | vent line |
| 110 | hose assembly |
| 111 | nozzle assembly |
| 112 | electronic controller |
| 113 | fuel filler neck assembly |
| 114 | sliding collar |
| 114a | collar core |
| 114b | collar cover |
| 114g | guide channel |
| 114p | restraint pin |
| 115 | partition plate |
| 116 | partition plate |
| 117a | plate orifice |
| 117b | plate orifice |
| 118 | compressed air channel |
| 119 | compressed air channel |
| 120 | fuel delivery system |
| 122 | fuel dispenser pump assembly |
| 124 | pump base |
| 125 | fuel hose protective covering |
| 126 | fuel hose to fuel nozzle connecter |
| 127 | female compressed air connector fitting |
| 129 | compressed air lines in nozzle body |
| 132a | air pressure line |
| 132b | air pressure line |
| 132a | compressed air line in nozzle spout |
| 132b | compressed air line in nozzle spout |
| 133 | nozzle cover |
| 134 | nozzle body |
| 135 | collar spring |
| 136 | central vent channel |
| 137 | nozzle spout |
| 138 | projecting vent channel |
| 139 | projecting vent channel |
| 140 | projecting vent channel |
| 141 | projecting vent channel |
| 142 | collar vent |
| 143 | locking flange on nozzle spout |
| 144 | curved slot |
| 145 | restrictor and nozzle guide |

-continued

| Reference Number Listing | |
|---|---|
| 146 | restrictor orifice |
| 147 | spring |
| 148 | door |
| 151 | guide tab |
| 152 | inclined flange guide |
| 153 | locking channel |
| 154 | flange stop |
| 155 | locking tooth |
| 200 | vehicle |

I claim:

1. A fuel delivery system configured to automatically select an appropriate fuel for a specific vehicle, out of a plurality of available fuels, said fuel delivery system comprising:

a fuel pump comprising a pump base, a hose assembly operatively attached to the pump base, and a nozzle assembly affixed to a distal end of the hose assembly, the fuel pump further comprising an electronic controller configured to select the appropriate fuel based on at least one signal received from the nozzle assembly;

the nozzle assembly comprising:

a valve subassembly including a trigger portion;

a nozzle spout in fluid communication with the nozzle fuel channel, the nozzle spout including a dispensing tube defining an outlet and having a stop member affixed to an exterior thereof, a cylindrical collar slidably mounted on the nozzle spout, and a spring disposed on the exterior of the dispensing tube between the stop member and the collar;

wherein the nozzle spout is configured to generate a collar position signal based on a position of the cylindrical collar on the dispensing tube when the dispensing tube is inserted into a fuel filler neck of the specific vehicle, and wherein the controller is configured to select the appropriate fuel based on the collar position signal received from the nozzle spout.

2. The fuel delivery system of claim 1, wherein the nozzle includes a wireless transmitter, and the signal is sent wirelessly to the controller.

3. The fuel delivery system of claim 1, wherein the signal is sent to the controller via optic fiber transmission.

4. The fuel delivery system of claim 1, wherein:

the fuel pump further comprises a connector for connecting to a source of hydraulic fluid or pressurized air;

the hose assembly has a hose fuel channel extending therethrough and at least one hose fluid channel extending therethrough separate from the hose fuel channel; and the nozzle assembly has a nozzle fuel channel extending therethrough and at least one nozzle fluid channel extending therethrough separate from the nozzle fuel channel.

5. The fuel delivery system of claim 4, wherein the fuel pump further comprises a signal converter including a main case body, at least one partition disposed in the main case body which divide an interior of the main case body into a high pressure chamber and a variable pressure chamber, and at least one pressure sensor attached to the main case body, the pressure sensor in fluid communication with the variable pressure chamber.

6. The system of claim 1, further comprising:

an alternative fuel hose disposed inside of an outer hose of the hose assembly, said alternative fuel hose in fluid communication with the nozzle assembly, and a check valve at a portion of the alternative fuel hose proximate the nozzle assembly, wherein said check valve is open when pressurized and closes when fluid pressure drops below a threshold level.

7. A fuel delivery system configured to automatically select an appropriate fuel for a specific vehicle, out of a plurality of available fuels, said fuel delivery system comprising:

a dispenser pump having an electronic controller therein;

a nozzle spout having a sliding collar thereon that, when displaced by a restrictor in the fuel filler neck, vents at least one air pressure line connected to the nozzle spout and originating at the dispenser pump;

a vehicle fuel filler neck with a restrictor member therein and disposed at specified distance from a locking channel in an inlet of the filler neck, wherein, when the fuel dispenser nozzle is inserted, displaces the collar said specified distance;

at least one pressurized air line extending to the nozzle spout from the dispenser pump; and at least one air pressure sensor in the dispenser pump that will generate a signal, readable by the electronic controller, when air pressure in the at least one air pressure line is reduced by a specified amount.

* * * * *